US008678850B2

(12) United States Patent
Nagasaka et al.

(10) Patent No.: US 8,678,850 B2
(45) Date of Patent: Mar. 25, 2014

(54) CONNECTOR AND JIG FOR CONNECTOR

(75) Inventors: Naokazu Nagasaka, Makinohara (JP); Osamu Oshita, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/565,090

(22) Filed: Aug. 2, 2012

(65) Prior Publication Data

US 2012/0295470 A1 Nov. 22, 2012

Related U.S. Application Data

(63) Continuation of application No. PCT/JP2011/052066, filed on Feb. 1, 2011.

(30) Foreign Application Priority Data

Feb. 3, 2010 (JP) ..... 2010-022144

(51) Int. Cl.
*H01R 13/64* (2006.01)

(52) U.S. Cl.
USPC ..... 439/378; 439/364

(58) Field of Classification Search
USPC ..... 439/364, 378, 357, 533, 479, 481, 152
See application file for complete search history.

(56) References Cited

U.S. PATENT DOCUMENTS

| | | | | |
|---|---|---|---|---|
| 5,720,624 | A | 2/1998 | Ikeda | |
| 7,217,161 | B1 * | 5/2007 | Tyler et al. | 439/748 |
| 7,588,454 | B2 * | 9/2009 | Nakata et al. | 439/357 |
| 7,955,098 | B1 * | 6/2011 | Mckee et al. | 439/157 |
| 2002/0072265 | A1 * | 6/2002 | Chen | 439/357 |
| 2005/0215106 | A1 * | 9/2005 | Holub | 439/357 |

FOREIGN PATENT DOCUMENTS

| | | | |
|---|---|---|---|
| JP | 455791 | U | 5/1992 |
| JP | 4199899 | A | 7/1992 |
| JP | 5182739 | A | 7/1993 |
| JP | 3285119 | B2 | 3/2002 |
| JP | 2004362832 | A | 12/2004 |

OTHER PUBLICATIONS

International Search Report dated Mar. 8, 2011 from the International Searching Authority in counterpart application No. PCT/JP2011/052066.

Written Opinion dated Mar. 8, 2011 from the International Searching Authority in counterpart application No. PCT/JP2011/052066.

* cited by examiner

*Primary Examiner* — Hae Moon Hyeon
(74) *Attorney, Agent, or Firm* — Sughrue Mion, PLLC

(57) ABSTRACT

A connector is provided which is lightened and has a simplified structure. A connector 7 includes a first connector 3 having a first connector main body part 41, a plurality of first terminals protruding from an upper surface of the first connector main body part, a tubular part 29 protruding from the upper surface of the first connector main body part so as to surround the first terminals and first protrusions 43 provided to protrude outside the tubular part, and a second connector 5 having a second connector main body part 35, a plurality of second terminals 11 which are provided on a bottom surface of the second connector main body part and into which the plurality of first terminals are respectively inserted and a second protrusion 47 protruding from an upper surface of the second connector main body part.

6 Claims, 20 Drawing Sheets

CONNECTOR AND JIG FOR CONNECTOR

CROSS REFERENCE TO RELATED APPLICATION

This application is a continuation of PCT application No. PCT/JP2011/052066, which was filed on Feb. 1, 2011 based on Japanese Patent Application (No. 2010-022144) filed on Feb. 3, 2010, the contents of which are incorporated herein by reference. Also, all the references cited herein are incorporated as a whole.

BACKGROUND OF THE INVENTION

1. Field of the Invention

The present invention relates to a connector and a jig for a connector, and a connector in which plural terminals of a male connector are detachably attached to plural terminals of a female connector and a jig for a connector used for the above-described attachment and detachment.

2. Description of the Related Art

FIG. 23 is a perspective view showing a rough structure of a usual connector 400 (see, for instance patent literature 1).

In the usual connector (a fitting type connector) 400, a first nut 404 having a tapped hole of a large diameter is provided in one connector 402. A through hole 406 is formed in a vertical direction of the first nut 404. In the first nut 404 and a rear part of the first nut 404, an abutting part 414 is formed relative to a collar shaped stopper part 410 and a head part 412 of a small diameter bolt 408 for fitting a connector.

Further, in the other connector 416, a second nut 418 having a tapped hole of a small diameter is provided. The small diameter bolt 408 for fitting the connector whose diameter is smaller than that of the tapped hole of the first nut 404 is inserted into the first nut 404 and screwed to the second nut 418 so that both the connectors 402 and 416 may be fitted to each other. A large diameter bolt (not shown in the drawing) for detaching the connector is screwed to the first nut 404 so that the other connector 416 may be pushed out by a front end of the large diameter bolt for detaching the connector.

Patent Literature 1: Japanese Patent No. 3285119

In the usual connector 400, since the bolt or the nut is provided for each of the connectors, a problem arises that a mass of the connector is increased (the connector is heavy) and the structure of the connector is complicated.

SUMMARY OF THE INVENTION

The present invention is devised by considering the above-described problems and it is an object of the present invention to provide a connector which is lightened and has a structure simplified and a jig for a connector used for attaching and detaching the connector.

A first invention concerns a connector including a first connector having a first connector main body part, plural first terminals protruding from an upper surface of the first connector main body part, a tubular part protruding from the upper surface of the first connector main body part so as to surround the first terminals and a first protrusion provided to protrude outside the tubular part, and a second connector having a second connector main body part, plural second terminals which are provided on a bottom surface of the second connector main body part and into which the plural first terminals are respectively inserted and a second protrusion protruding from an upper surface of the second connector main body part.

A second invention concerns a connector according to the connector of the first invention, wherein a first connector lock part is provided in the tubular part of the first connector, a second connector lock part is provided in the second connector main body part, the second connector lock part is engaged with the first connector lock part and elastically deformed in the course of connecting the first terminals to the second terminals, and restored to be engaged with the first connector lock part when the first terminals are completely connected to the second terminals so that the second terminals are prevented from being detached from the first terminals, and the second connector lock part is elastically deformed by applying a prescribed external force thereto when the first terminals are connected to the second terminals so that the second connector lock part is disengaged from the first connector lock part, and the second connector lock part is separated from the first connector lock part and restored when the second terminals are completely detached from the first terminals.

A third invention concerns a connector including a first connector having plural first terminals and a second connector having plural second terminals connected to the plural first terminals respectively, wherein the connectors are connected to each other in such a way that engaging parts of a jig for a connector are engaged with first engaged parts of the first connector, and under a state that a push-in part of the jig for the connector is allowed to abut on a second abutted part of the second connector, the second connector is pushed by the push-in part of the jig for the connector so as to allow the second connector to come close to the first connector, and the connectors are detached from each other in such a way that abutting parts of the jig for the connector are allowed to abut on first abutted parts of the first connector, and under a state that pull-out parts of the jig for the connector are engaged with second engaged parts of the second connector, the second connector is pulled out by the pull-out parts of the jig for the connector so as to detach the second connector from the first connector.

A fourth invention concerns a connector according the connector of the third invention, wherein a first connector lock part is provided in the first connector, a second connector lock part is provided in the second connector, the second connector lock part is engaged with the first connector lock part and elastically deformed in the course of connecting the first terminals to the second terminals, and restored to be engaged with the first connector lock part when the first terminals are completely connected to the second terminals so that the second terminals are prevented from being detached from the first terminals, and the second connector lock part is elastically deformed by applying a prescribed external force thereto when the first terminals are connected to the second terminals so that the second connector lock part is disengaged from the first connector lock part, and the second connector lock part is separated from the first connector lock part and restored when the second terminals are completely detached from the first terminals.

A fifth invention concerns a jig for a connector used when a first connector is connected to a second connector and when the first connector and the second connector are detached from each other. The jig for the connector includes a jig main body part having abutting parts abutting on first abutted parts of the first connector, engaging members having engaging parts engaged with first engaged parts of the first connector and supported by the jig main body part and a moving member which supports a push-in member abutting on a second abutted part of the second connector or supports a pull-out member engaged with second engaged parts of the second connector and is engaged with the jig main body part to move in a prescribed direction.

A sixth invention concerns a jig for a connector according to the jig for the connector of the fifth invention, wherein when the first connector is connected to the second connector, the push-in member is supported by the moving member, the engaging parts of the engaging members are engaged with the engaged parts of the first connector, and the moving member is moved so as to push the second connector to the first connector side so that the push-in member is allowed to abut on the abutted part of the female connector and pushes the second connector to the first connector side, and when the first connector and the second connector are detached from each other, the pull-out member is supported by the moving member, the abutting parts of the jig main body part are allowed to abut on the abutted parts of the first connector, the pull-out member is engaged with the engaged parts of the second connector and the moving member is moved so as to detach the second connector from the first connector so that the second connector is separated from the first connector.

BRIEF DESCRIPTION OF THE DRAWINGS

FIG. 9(*b*) is an enlarged view of a part IX in FIG. 9(*a*).

FIG. 21(*b*) is a front view during the engaging operation of the pull-out member.

DESCRIPTION OF THE PREFERRED EMBODIMENTS

Figure 1:
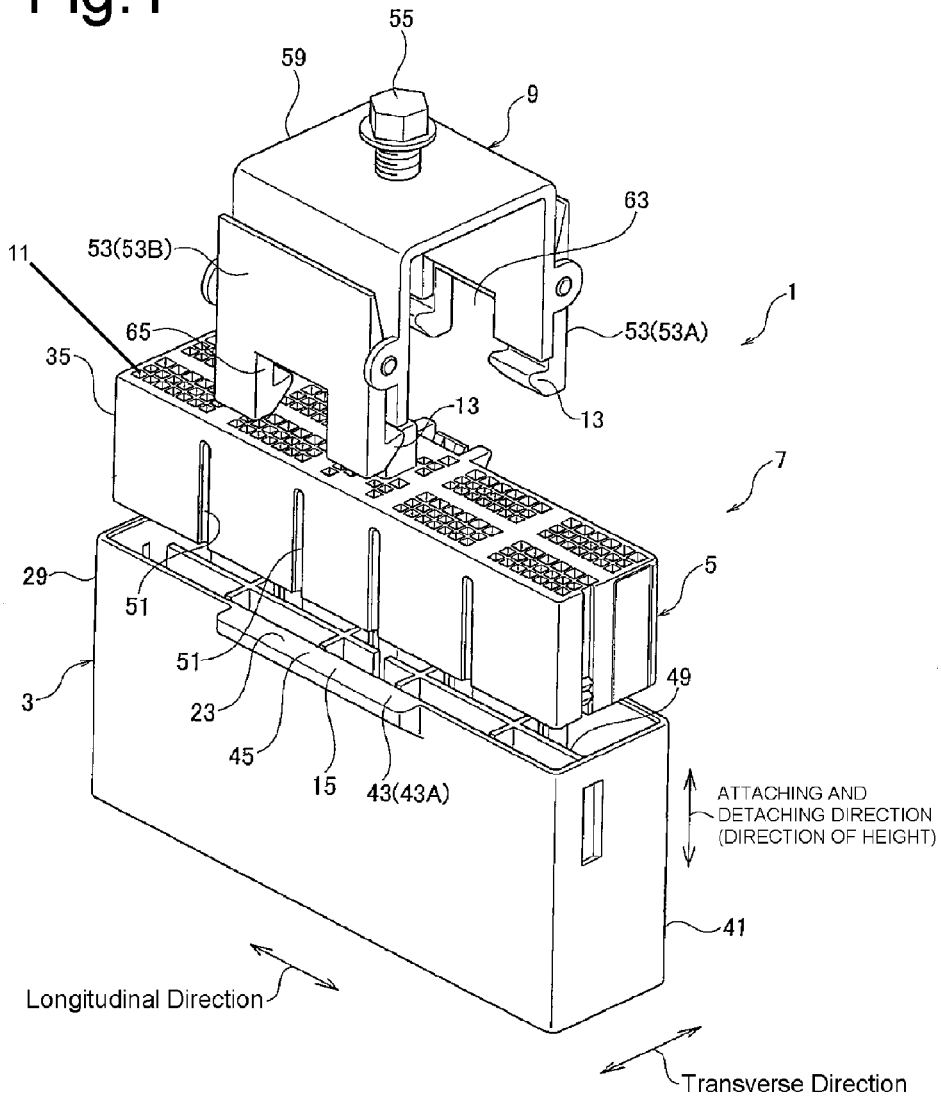
FIG. 1 is a perspective view showing a schematic structure of a detachably attaching connector system according to an exemplary embodiment of the present invention.
Figure 2:
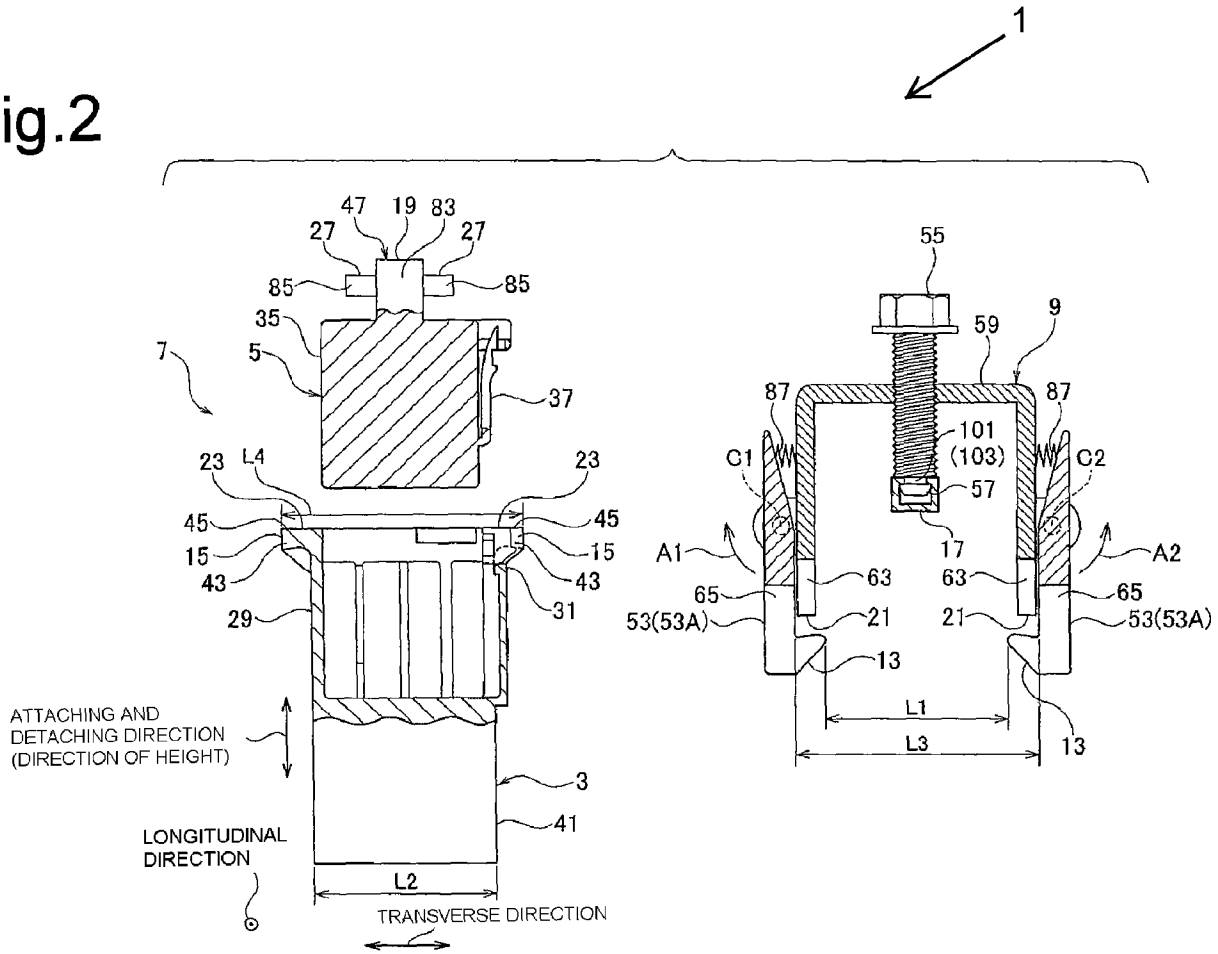
FIG. 2 is a side view showing the schematic structure of the detachably attaching connector system.

FIG. 1 is a perspective view showing a schematic structure of a detachably attaching connector system 1 according to an exemplary embodiment of the present invention. FIG. 2 is a side view showing the schematic structure of the detachably attaching connector system 1.

The detachably attaching connector system 1 includes a connector 7 having a first connector (for instance, a male connector) 3 and a second connector (for instance, a female connector) 5 and a jig 9 for a connector as a separate member from the connector 7. The female connector 5 is a separate member from the male connector 3. The male connector 3 is detachably attached (freely connected to and detached from) the female connector 5. Further, the above-described attaching and detaching operations are carried out by using the jig 9 for the connector.

In the specification of this application, for the convenience of explanation, one prescribed direction may be occasionally set as a longitudinal direction, a direction orthogonal to the longitudinal direction may be set as a transverse direction and a direction orthogonal to the longitudinal direction and the transverse direction may be set as an attaching and detaching direction (a direction of height).

The male connector 3 includes plural first terminals (not shown in the drawing). The female connector 5 includes plural second terminals 11. The plural first terminals are respectively connected (actually connected) to the plural second terminals 11. A detail of the actual connection will be described below.

When the connectors 3 and 5 are connected to each other (the first terminals of the male connector 3 are connected to the second terminals 11 of the female connector 5 which are respectively separated from the first terminals of the male connector 3), engaging parts 13 of the jig 9 for the connector are initially engaged with first engaged parts 15 of the male connector 3 and a push-in part 17 of the jig 9 for the connector is allowed to abut on a second abutted part 19 of the female connector 5.

Subsequently, under a state that the above-described engagement and abutment are achieved, the female connector 5 is pushed by the push-in part 17 of the jig 9 for the connector so that the female connector 5 may come close to the male connector 3 (the first terminals of the male connector 3 may be inserted into the second terminals 11 of the female connector 5).

On the other hand, when the male connector 3 and the female connector 5 which are connected to each other are detached from each other, the pull-out member 61 is initially supported by the bolt 55. Then, the abutting parts 21 of the jig main body part 59 are allowed to abut on the first abutted parts 23 (the end surfaces 45) of the male connector 3 to engage the pull-out parts 25 (see, e.g., FIGS. 19-22) of the pull-out member 61 with the second engaged parts 27 of the female connector 5. Subsequently, the external force is applied to the second connector lock part 37 of the female connector 5 to disengage the second connector lock part 37 from the first connector lock part 31 of the male connector 3. Then, the female connector 5 is pulled out from the male connector so as to be detached from the male connector by moving the bolt 55. Then, the female connector 5 is separated from the male connector 3.

Subsequently, under a state that the above-described abutment and the above-described engagement are achieved, the female connector 5 is pulled out by the pull-out parts 25 of the jig 9 for the connector so that the female connector 5 may be detached from the male connector 3(the first terminals of the male connector 3 may be slipped out of the second terminals 11 of the female connector 5).

Further, in the male connector 3 (for instance, a tubular part 29 of the male connector 3), a first connector lock part 31 and first connector temporarily engaging parts 33 are provided. The first connector lock part 31 and the first connector temporarily engaging parts 33 are separated from each other.

In the female connector 5 (for instance, a second connector main body part 35 of the female connector 5), a second connector lock part 37 and second connector temporarily engaging parts 39 are provided. The second connector lock part 37 and the second connector temporarily engaging parts 39 are separated from each other and separately provided.

While the first terminals of the male connector 3 are connected to the second terminals 11 of the female connector 5, the second connector lock part 37 is engaged with (for instance, come into contact with) the first connector lock part 31 and elastically deformed.

Further, when the first terminals of the male connector 3 are completely connected to the second terminals 11 of the female connector 5 (completed) (when the first terminals are fully connected to the second terminals 11; when the male connector 3 is fully connected to the female connector 5), the second connector lock part 37 is restored. In accordance with this restoration, the second connector lock part 37 is engaged with the first connector lock part 31, so that the second terminals 11 of the female connector 5 can be prevented from being detached from the first terminals of the male connector 3.

Further, when the first terminals of the male connector 3 are connected (fully connected) to the second terminals 11 of the female connector 5, the second connector lock part 37 is elastically deformed by applying a prescribed external force (by receiving a prescribed external force), so that the second connector lock part 37 is disengaged from the first connector lock part 31. Namely, a prevention of detachment of the second terminals 11 from the first terminals is cancelled so that the female connector 5 may be detached from the male connector 3.

Further, while the second terminals 11 of the female connector 5 are detached from the first terminals of the male connector 3, the second connector lock part 37 is engaged with (for instance, come into contact with) the first connector lock part 31 and elastically deformed. When the second terminals 11 of the female connector 5 are completely detached form the first terminals of the male connector 3, the second connector lock part 37 is disengaged from the first connector lock part 31 and restored.

When the first terminals of the male connector 3 are connected to the second terminals 11 of the female connector 5, the second connector temporarily engaging parts 39 are engaged with the first connector temporarily engaging parts 33 to temporarily connect the male connector 3 (for instance, the tubular part 29) to the female connector 5 (for instance, the second connector main body part 35). A detail of a temporary connection will be described below.

The male connector 3 includes a first connector main body part 41, the above-described plural first terminals (not shown in the drawing), the tubular part 29 and first protrusions 43. The first terminals are male terminals made of metal and formed in, for instance, the shapes of needles. Resin parts of the first connector main body part 41, the tubular part 29 and the first protrusions 43 except the first terminals are integrally formed by, for instance, a molding.

The plural first terminals protrude from an upper surface of the first connector main body part 41. The tubular part 29 protrudes from the upper surface of the first connector main body part 41 so as to surround the plural first terminals (accommodate the first terminals inside). The first protrusions 43 are provided to protrude in an end (an upper end) part side (for instance, an end part) of the tubular part 29, outside the tubular part 29 from an outer peripheral wall of the tubular part 29 (in a direction orthogonal to an extending direction of the tubular part 29 and in a side separating from the center of the tubular part 29) and symmetrically with respect to the center of the tubular part 29(a detail of "symmetrically" will be described below.).

Then, for instance, the first protrusions 43 form the above-described first engaged parts 15 and the above-described first abutted parts 23.

From a bottom surface of the first connector main body part 41 of the male connector 3, are extended plural wirings (for instance, electric wires having flexibility; not shown in the drawing) corresponding to the plural first terminals.

The female connector 5 includes the above-described second connector main body part 35, the plural second terminals 11 and a second protrusion 47. The second terminals 11 are female terminals made of metal to which the needle shaped male terminals (the first terminals of the male connector 3) are fitted and are provided in a bottom surface of the second connector main body part 35 so as to be recessed toward an upper surface side from the bottom surface. The plural first terminals are respectively inserted into the second terminals 11 with an insertion resistance (a reaction force during an insertion) so that the plural first terminals are respectively electrically connected to the plural second terminals 11.

The second protrusion 47 protrudes from an upper surface of the second connector main body part 35 at a substantially central part of the upper surface. For instance, a part of the second protrusion 47 forms the above-described second abutted part 19 and the other one part of the second protrusion 47 forms the above-described second engaged parts 27.

Resin parts of the second connector main body part 35 and the second protrusion 47 except the second terminals 11 are integrally formed by, for instance, a molding. Further, from the upper surface of the second connector main body part 35 of the female connector 5, are extended plural wirings (for instance, electric wires having flexibility; not shown in the drawing) corresponding to the plural second terminals 11.

In the tubular part 29 of the male connector 3, ribs 49 extending from the upper surface of the first connector main body part 41 are provided so as to avoid the first terminals. Further, on the bottom surface of the second connector main body part 35 of the female connector 5, grooves 51 are provided which are engaged with (for instance, fitted to) the ribs 49 when the female connector 5 is connected to the first connector (the first terminals are connected to the second terminals 11).

Then, when the female connector 5 is connected to the male connector 3, the grooves 51 are engaged with (for instance, form sliding pairs to be engaged with) the ribs 49, or a side surface of the second connector main body part 35 is engaged with (for instance, engaged with by forming sliding pairs) an inner wall of the tubular part 29, or the side surface of the second connector main body part 35 is engaged with the inner wall of the tubular part 29 and the grooves 51 are engaged with the ribs 49. Thus, the female connector 5 is guided so as to move in an attaching and detaching direction relative to the male connector 3.

Here, a state of the temporary connection indicates one state in the course of a connection of the female connector 5 to the male connector 3. In the state of the temporary connection, the female connector is guided by the above-described ribs 49 or the like and the first connector temporarily engaging parts 33 of the male connector 3 are engaged with the second connector temporarily engaging parts 39 of the female connector 5. The first terminals of the male connector 3 are separated from the second terminals 11 of the female connector 5 and are not connected thereto.

In order to temporarily connect the connectors 3 and 5 which are respectively separated from (detached from) each other, a large force is not necessary. For instance, the female connector 5 (the second connector main body part 35) may be inserted into and fitted to the male connector 3 (the tubular part 29) by empty hands. Under the state of the temporary connection, the first connector temporarily engaging parts 33 of the male connector 3 are engaged with the second connector temporarily engaging parts 39 of the female connector 5. Thus, the temporarily connected state can be maintained.

In order to change the temporarily connected state to a fully connected state (a state that the first terminals of the male connector 3 are completely connected to the second terminals 11 of the female connector 5), the second connector main body part 35 of the female connector 5 needs to be pushed in to the tubular part 29 of the male connector 3 with a large force (a force of a level that cannot be given by the empty hands).

A reason why such a large force is necessary resides in that many terminals 11 are provided in the connectors 3 and 5 respectively. Namely, when only one first terminal is provided in the male terminal 3 and this one terminal is inserted into and connected to the one terminal 11 of the female connector 5, a resistance force (the force of the terminal) during the connection is low. Thus, the terminals can be connected to each other with a small force by the empty hands.

However, the plural (a large number) terminals are provided in the male connector 3 and the plural (a large number) terminals are also provided in the female connector 5. Further, in the connector 7, since many terminals are connected at the same time (multi-polar terminals are connected together), the resistance force for the connection is high. Accordingly, the large force is necessary to fully connect the male connector to the female connector.

Thus, in order to change the temporarily connected state to the fully connected state, the jig 9 for the connector is necessary. To obtain the fully connected state from the temporarily connected state by using the jig 9 for the connector, when a prescribed large force is applied respectively to the connectors 3 and 5, the engaged state of the connector temporarily engaging parts 33 and 39 of the connectors respectively is initially released. Then, the first terminals of the male connector 3 are inserted into the second terminals 11 of the female connector 5 to obtain the fully connected state. In the fully connected state, the connector 7 is installed and used on a vehicle such as a motor vehicle.

Further, as described above, in the fully connected state, the second connector lock part 37 is engaged with the first connector lock part 31, so that the second terminals 11 are prevented from being detached from the first terminals (the female connector 5 is detached from the male connector 3).

Even in a structure having no connector lock parts 31 and 37 provided, the connectors 3 and 5 which are connected to each other once (fully connected to each other) are not easily detached from each other. However, when the connector lock parts 31 and 37 are not respectively provided, there is a fear that a connection of the connectors 3 and 5 may be loosened due to a vibration or the connectors 3 and 5 may be respectively disengaged (detached) from each other. Thus, the connector lock parts 31 and 37 are respectively provided to prevent the connectors 3 and 5 from being loosened due to the vibration.

When the connectors 3 and 5 which are respectively connected to each other (fully connected to each other) are detached from each other, since the large force is necessary similarly to that when the connectors 3 and 5 are connected to each other, the jig 9 for the connector is required. In the fully connected state, since the second terminals 11 of the female connector 5 are prevented from being detached from the first terminals (the terminals of the male connector 3) by the connector lock parts 31 and 37, the connectors 3 and 5 which are fully connected to each other cannot be separated from each other even by using the jig 9 for the connector. When the connectors 3 and 5 which are fully connected to each other are detached from each other, an external force is separately applied to the second connector lock part 37 of the female connector 5 to elastically deform the second connector lock part 37. Thus, the second connector lock part 37 is disengaged from the first connector lock part 31. Then, the female connector 5 needs to be pulled out from the male connector 3 by using the jig 9 for the connector.

In the connector 7, the first connector lock part 31 of the male connector 3 may be elastically deformed in place of the second connector lock part 37 of the female connector 5.

Now, the first protrusions 43 (the first engaged parts 15) provided so as to protrude symmetrically with respect to the center of the tubular part 29 of the male connector 3 and the second protrusion 47 (the second abutted part 19, the second engaged parts 27) of the female connector 5 will be described below.

For instance, plural first protrusions 43 are provided. When the male connector 3 and the female connector 5 are temporarily connected to each other or fully connected to each other, if the male connector 3 and the female connector 5 are respectively seen from the direction of height (the attaching and detaching direction) of the connectors 3 and 5, the second protrusion 47 of the female connector 5 is located inside a polygonal form which inscribes the plural first protrusions 43 or a contour (a contour enveloping the plural first protrusions 43) which inscribes the plural first protrusions 43 (for instance, a position of the center).

Figure 3:
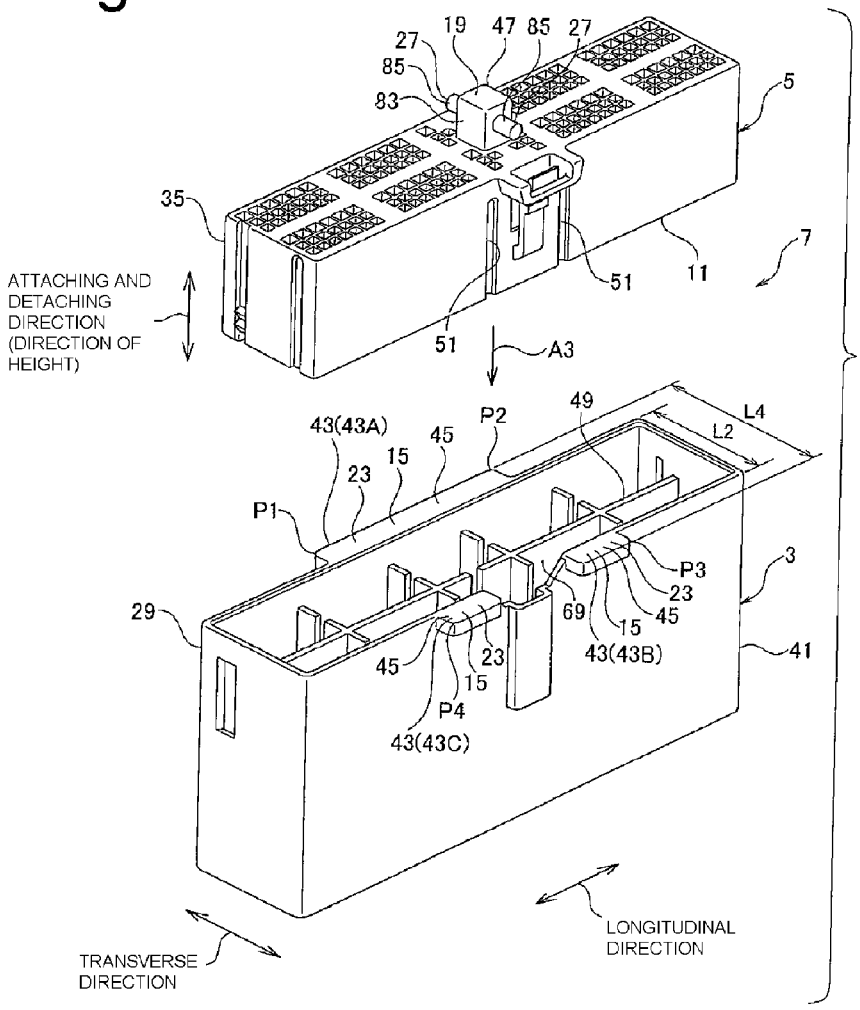
FIG. 3 is a perspective view showing a schematic structure of a male connector and a female connector.

Specifically, as shown in FIG. 3, for instance, the three first protrusions 43 are provided (the protrusions 43A, 43B, 43C). The polygonal form inscribed by the first protrusions 43A, 43B and 43C respectively is a rectangular form (a rectangular form that connects together points P1, P2, P3 and P4). The second protrusion 47 of the second connector is located at an intersection point of diagonal lines of the rectangular form.

Then, in order to fully connect the connectors 3 and 5 to each other by using the jig 9 for the connector, the engaging parts 13 of plural engaging members 53 of the jig 9 for the connector are respectively engaged with the plural first protrusions 43 and a push-in member 57 arranged in a moving member (for instance, a bolt) 55 of the jig 9 for the connector is engaged with the second protrusion 47. Accordingly, when the connectors 3 and 5 are fully connected to each other, a moment (an angular moment on an axis extending in the transverse direction and an angular moment on an axis extending in the longitudinally direction) is hardly generated in the female connector 5. Thus, the female connector 5 is smoothly moved relative to the male connector 3 (the female connector 5 is smoothly fitted to the male connector 3).

Further, in order to detach the connectors 3 and 5 from each other by using the jig 9 for the connector, the plural abutting parts 21 provided in a jig main body part 59 of the jig 9 for the connector are respectively allowed to abut on upper surfaces (end surfaces 45) of the plural first protrusions 43 and a pull-out member 61 arranged in the bolt 55 of the jig 9 for the connector is engaged with the second protrusion 47. Thus, when the connectors 3 and 5 are detached from each other, a moment is hardly generated in the female connector 5, so that the female connector 5 can be smoothly detached form the male connector 3.

Now, the jig 9 for the connector will be described below in detail.

As described above, the jig 9 for the connector is a jig used when the male connector 3 and the female connector 5 separated from each other are connected to each other or the male connector 3 and the female connector 5 connected each other are detached from each other. The jig 9 for the connector includes the jig main body part 59, one pair of engaging members 53 (first engaging members) 53 (53A, 53B) and the moving member (for instance, the bolt) 55.

In the jig main body part 59, are provided prescribed cut-out parts 63 and the abutting parts 21 abutting on the first abutted parts 23 (the end surfaces 45) of the male connector 3.

The engaging members 53 include prescribed cut-out parts 65 and the engaging parts 13 engaged with the engaged parts (the first engaged parts) 15 of the male connector 3. Further, the engaging members 53 are supported by the jig main body part 59 so as to freely rotate. Since the engaging members 53 are supported so as to freely rotate, when the jig 9 for the connector is arranged on the connectors 3 and 5 respectively, the engaging parts 13 of the engaging members 53 abut on the first engaged parts 15 of the male connector 3 and the engaging members 53 rotate (see FIG. 12 or FIG. 13). Thus, the jig 9 for the connector is easily arranged on the connectors 3 and 5 respectively.

The bolt 55 supports the push-in member (the push-in member having the push-in part 17) 57 abutting on the second abutted part 19 of the female connector 5 or supports the pull-out member (the pull-out member having the pull-out parts 25) 61 engaged with the second engaged parts 27 of the female connector 5. Further, the bolt 55 is engaged with (for instance, screwed to) the jig main body part 59 to move in a prescribed direction (the direction of height). Further, the push-in member 57 or the pull-out member 61 is easily detachably attached to the bolt 55.

When the male connector 3 and the female connector 5 which are detached from each other are connected to each other, the push-in member 57 is initially supported by the bolt 55. Then, under a state that the male connector 3 is temporarily connected to the female connector 5, the engaging parts 13 of the engaging members 53 are engaged with the first engaged parts 15 of the male connector 3. Then, the bolt 55 is rotated and moved in a direction for pushing (pushing-in direction) the female connector 5 to the male connector 3 to allow the push-in part 17 of the push-in member 57 to abut on the second abutted part 19 of the female connector 5. Thus, the female connector 5 is pushed toward the male connector 3 side by moving the bolt 55.

On the other hand, when the male connector 3 and the female connector 5 which are connected to each other are detached from each other, the pull-out member 61 is initially supported by the bolt 55. Then, the abutting parts 21 of the jig main body part 59 are allowed to abut on the first abutted parts 23 (the end surfaces 45) of the male connector 3 to engage the pull-out parts 25 of the pull-out member 61 with the second engaged parts 27 of the female connector 5. Subsequently, the external force is applied to the second connector lock part 37 of the female connector 5 to disengage the second connector lock part 37 from the first connector lock part 31 of the male connector 3. Then, the female connector 5 is pulled out from the male connector so as to be detached from the male connector by moving the bolt 55. Then, the female connector 5 is separated from the male connector 3.

As described above, in the male connector 3, the first connector lock part 31 is provided. In the female connector 5, the second connector lock part 37 is provided. Since the cut-out parts 63 and 65 are provided in the jig main body part 59 and the engaging members 53, when the male connector 3 and the female connector 5 which are connected to each other are detached from each other, the prescribed external force can be applied to the second connector lock part 37. Namely, the force is applied to the second connector lock part 37 (see an arrow mark AR in FIG. 18) directly by fingers or using a tool through the cut-out parts 63 of the jig main body part 59 and the cut-out parts 65 of the engaging members 53 to elastically deform the second connector lock part 37. Thus, a function for preventing the detachment of the female connector 5 from the male connector 3 is released.

Now, the connector 7 (the male connector 3, the female connector 5) and the jig 9 for the connector will be described below in more detail. FIG. 3 is a perspective view showing a schematic structure of the male connector 3 and the female connector 5. In FIG. 3, the male connector 3 and the female connector 5 are detached from each other. Referring to FIG. 1 and FIG. 3, the male connector 3, the female connector 5 and the jig 9 for the connector are substantially symmetrically formed relative to planes (planes expanding in the direction of height and in the longitudinal direction) passing the center of the connector 7 or the jig 9 for the connector and orthogonal to the transverse direction. Further, the male connector 3, the female connector 5 and the jig 9 for the connector are substantially symmetrically formed relative to planes (planes expanding in the direction of height and in the transverse direction) passing the center of the connector 7 or the jig 9 for the connector and orthogonal to the longitudinal direction.

Initially, the male connector 3 will be described below. The first connector main body part 41 of the male connector 3 is formed in the shape of a rectangular parallelepiped. On the upper surface of the first connector main body part 41, the plural first terminal (not shown in the drawing) are provided to protrude upward. The terminals are respectively arranged in the form of a matrix at prescribed intervals in the transverse direction and in the longitudinal direction. The tubular part 29 is also formed in a rectangular shape and protrudes from the upper surface of the first connector main body part 41. Side surfaces of the tubular part 29 are provided in extensions of side surfaces of the first connector main body part 41. Namely, when the male connector 3 is seen from the direction of height in FIGS. 1 and 3, an external form of the male connector 3(the first connector main body part 41, the tubular part 29) is rectangular.

An extended height of the tubular part 29 from the first connector main body part 41 is larger than an extended height of the first terminals of the male connector 3. Accordingly, when the male connector 3 is seen from the side surface in the transverse direction, the first terminals of the male connector 3 are hidden in the tubular part 29.

As the first protrusions 43 forming the first engaged parts 15, the three first protrusions are provided as shown in FIG. 3 or as described above. The protrusions 43A, 43B and 43C are formed in the shapes of rectangular plates.

A dimension of the protrusion 43A in a direction of length (the longitudinal direction) is smaller than a dimension of the tubular part 29 in the longitudinal direction. A dimension of the protrusion 43A in the direction of height (a direction of thickness) is sufficiently smaller than the dimension of the tubular part 29 in the longitudinal direction, equal to the thickness of the tubular part 29 or slightly larger than the thickness of the tubular part 29. A dimension of the protrusion 43A in the transverse direction (a direction of width) is equal to the dimension of the protrusion 43A in the direction of thickness or slightly larger than a dimension of the protrusion 43A in the direction of width.

The longitudinal direction of the protrusion 43A corresponds to the longitudinal direction of the tubular part 29. The direction of thickness of the protrusion 43A corresponds to the direction of height of the tubular part 29. The direction of width of the protrusion 43A corresponds to the transverse direction of the tubular part 29. Further, the protrusion 43A protrudes from one side surface of the tubular part 29 in the transverse direction in an intermediate part of the tubular part 29 in the longitudinal direction and in the upper end part of the tubular part 29 and is provided integrally with the tubular part 29. The one surface (the upper surface 45) of the protrusion 43A in the direction of thickness and the upper surface of the tubular part 29 are located on one plane (a plane orthogonal to the direction of height). Further, the upper surface 45 of the protrusion 43A forms the first abutted part 23.

The protrusion 43B and the protrusion 43C are formed so as to have substantially the same figures. Dimensions of the protrusion 43B in the direction of thickness and in the direction of width are substantially the same as the dimensions of the protrusion 43A. On the other hand, a dimension of the protrusion 43B in the longitudinal direction is smaller than the dimension of the protrusion 43A in the longitudinal direction. Further, the total of the dimension of the protrusion 43B in the longitudinal direction and the dimension of the protrusion 43C in the longitudinal direction is smaller than the dimension of the protrusion 43A in the longitudinal direction.

The protrusions 43B and 43C protrude from the other side surface of the tubular part 29 in the transverse direction and are provided integrally with the tubular part 29 like the protrusion 43A. In more explaining, the protrusions 43B and 43C are respectively provided at prescribed intervals (spaced from each other by a cut-out part 69) in the longitudinal direction of the tubular part 29. Further, if a space is not provided between the protrusions 43B and 43C respectively and the protrusions 43B and 43C are connected to each other like the protrusion 43A, a virtual connected protrusion has the same form as that of the protrusion 43A.

Figure 17:
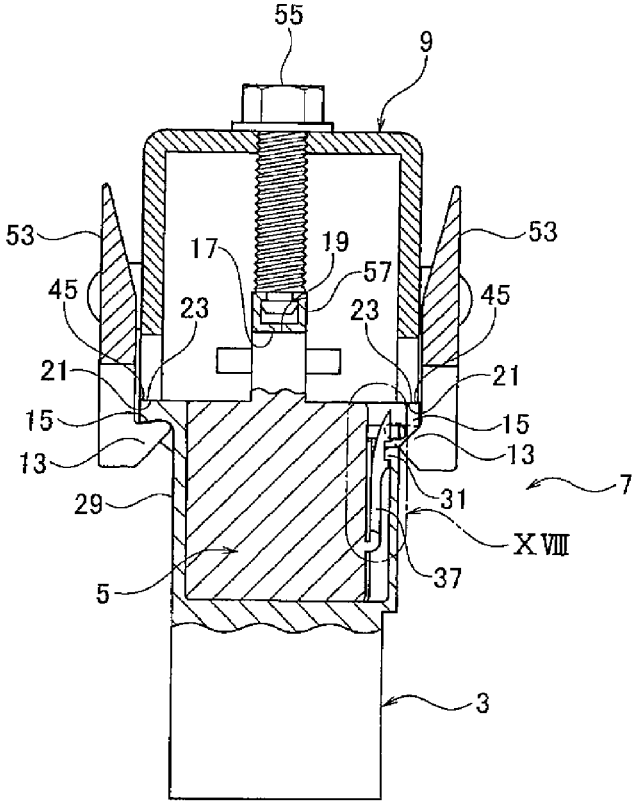
FIG. 17 is a view showing a state that the male connector is actually connected to the female connector by the jig for the connector.
Figure 18:
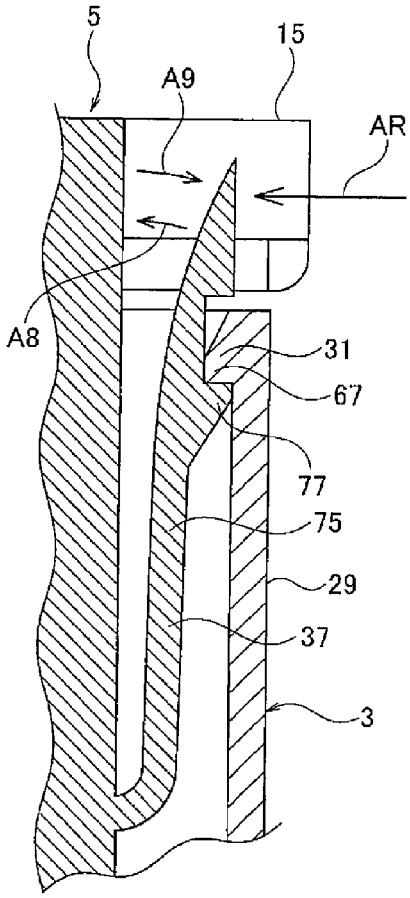
FIG. 18 is an enlarged view of a part XVIII in FIG. 17.

The first connector lock part 31 is formed with a protrusion 67 formed integrally with the tubular part 29 (for instance, see FIG. 18 as an enlarged view of a part XVIII in FIG. 17). The protrusion 67 is integrally formed on one plate shaped side wall of the tubular part (a side wall provided with the protrusions 43B and 43C respectively). The protrusion 67 is provided in the central part of the longitudinal direction of the tubular part 29 (the female connector 5) (between the protrusions 43B and 43C) and in the vicinity of an end part of the tubular part 29 in the direction of height (an upper end part in the part of the tubular part 29 where the cut-out part 69 is provided). Further, the protrusion 67 protrudes inside (to the center) of the tubular part 29 from an inner wall of the tubular part 29.

Figure 7:
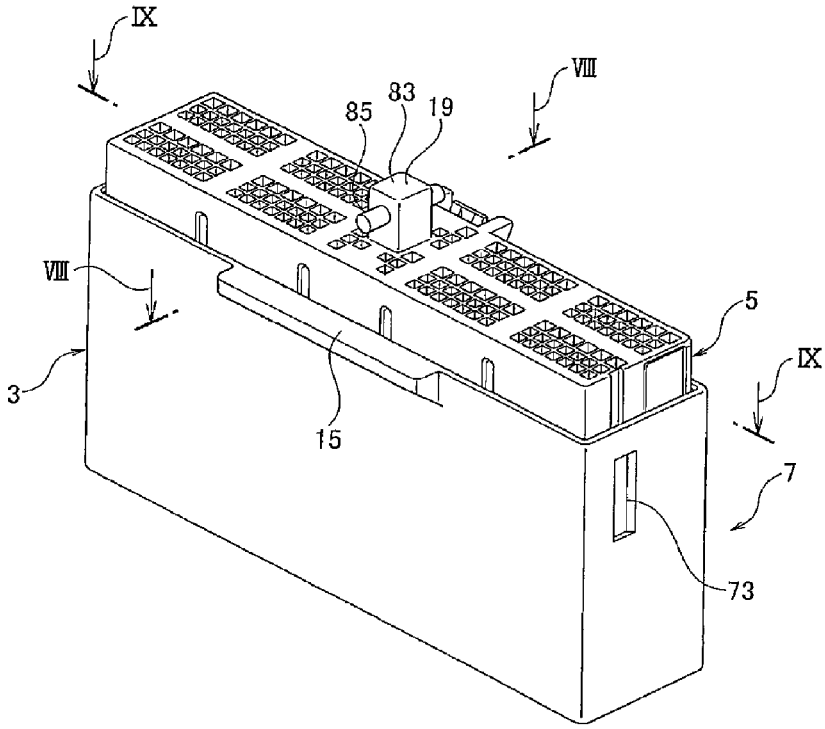
FIG. 7 is a perspective view showing the male connector and the female connector in a temporarily connected state.
Figure 9A:
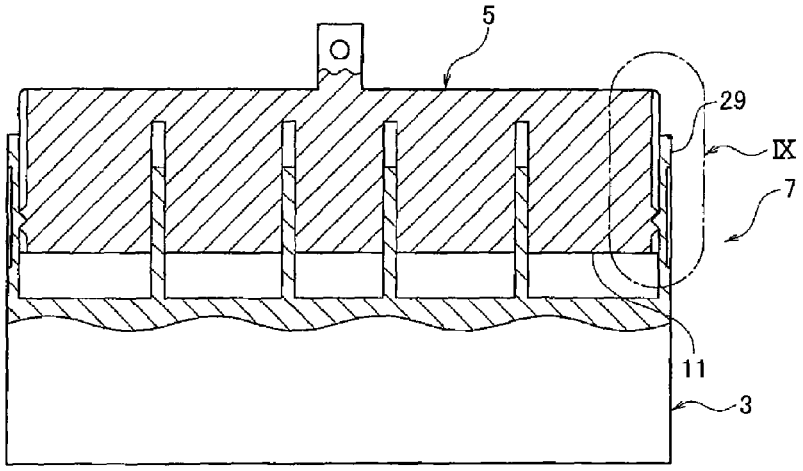
FIG. 9(*a*) is a view showing a section taken along a line IX-IX in FIG. 7.
Figure 9B:
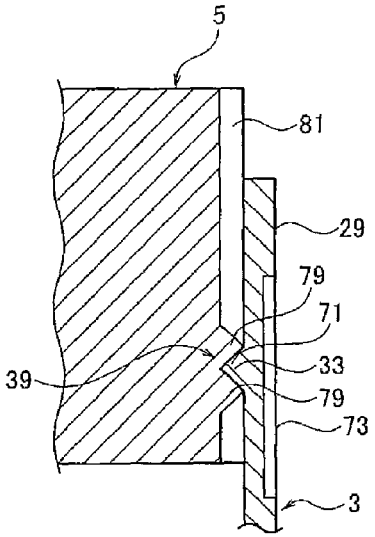

The first connector temporarily engaging parts 33 are formed with protrusions 71 integrally formed with the tubular part 29 (for instance, see FIG. 9(*b*) as an enlarged view of a part IX of FIG. 9(*a*) showing a section taken along a line IX-IX in FIG. 7). The protrusions 71 are respectively provided in two plate shaped side walls of the tubular part 29 (a pair of side walls located at both end parts in the longitudinal direction of the male connector 3). Further, the protrusions 71 are provided in a lower side of the tubular part 29 in the longitudinal direction of the tubular part 29 (the first connector main body part 41 side) and in an intermediate part of the tubular part 29 in the transverse direction of the tubular part 29. Further, the protrusions 71 protrude inside (to the center) of the tubular part 29 from the inner wall of the tubular part 29.

In the parts of the tubular part 29 of the back sides (outer sides) of the protrusions 71, recessed parts 73 are provided. Thus, when the first connector temporarily engaging parts 33 are engaged with the second connector temporarily engaging parts 39, the first connector temporarily engaging parts 33 are easily elastically deformed.

Now, the female connector 5 will be described below.

The second connector main body part 35 of the female connector 5 is formed in the shape of a rectangular parallelepiped as shown in FIG. 3. The plural second terminals 11 are provided in the bottom surface (the lower surface) so as to be recessed upward. The terminals 11 are respectively arranged in the form of a matrix at prescribed intervals in the transverse direction and in the longitudinal direction correspondingly to the first terminals of the male connector 3. A dimension of the second connector main body part 35 in the longitudinal direction is substantially equal to a dimension between inner surfaces (inner walls) in the longitudinal direction of the tubular part 29. A dimension of the second connector main body part 35 in the transverse direction is substantially equal to a dimension between inner surfaces (inner walls) in the transverse direction of the tubular part 29. A dimension of the second connector main body part 35 in the direction of height is substantially equal to a dimension of the tubular part 29 in the direction of height.

As shown in FIG. 18, the second connector lock part 37 of the female connector 5 includes a rod shaped part 75 having flexibility. A protruding part (a protrusion) 77 provided in an intermediate part (for instance, an end part side) of the longitudinal direction of the rod shaped part 75 is engaged with the protrusion 67 forming the first connector lock part 31 to prevent the detachment of the fully connected connector 7 (the male connector 3, the female connector 5).

The rod shaped part 75 is provided in the second connector main body part 35 by an integral molding. A base end part of the rod shaped part 75 is connected to the second connector main body part 35 and a longitudinal direction of the rod shaped part 75 corresponds to the direction of height of the second connector main body part 35 (the female connector 5). The rod shaped part 75 is a little spaced from the second connector main body part 35 and extended upward from a lower part of the second connector main body part 35. Further, the base end part of the rod shaped part 75 is located in a central part of the second connector main body part 35 in the longitudinal direction, in a lower side of the second connector main body part 35 in the direction of height, and in one plane in the transverse direction of the second connector main body part 35 in the transverse direction.

In the course of connecting the male connector 3 and the female connector 5 to each other, the rod shaped part 75 (for instance, the protruding part 77) abuts on the first connector lock part 31 so that the rod shaped part 75 may be elastically deformed and bent (in a direction shown by an arrow mark A8 in FIG. 18) so as to decrease a space between the rod shaped part 75 and the second connector main body part 35. Further, when the connection of the male connector 3 and the female connector 5 is completed, the rod shaped part 75 is restored (restored in a direction shown by an arrow mark A9 in FIG. 18). Thus, the protruding part 77 of the rod shaped part 75 is located in a lower side of the protrusion 67 provided in the tubular part 29 of the male connector 3 as shown in FIG. 18 so that the protruding part 77 abuts on the protrusion 67 and the female connector 5 does not slip out from the male connector 3 (the detachment of the connectors 3 and 5 respectively is prevented). Further, under a state that the connectors 3 and 5 are respectively fully connected to each other, when the external force (the force shown by the arrow mark AR in FIG. 18) is applied to the end part of the rod shaped part 75, the rod shaped part 75 (the protruding part 77) is disengaged from the protrusion 67 of the female connector 5 to release a prevention of the detachment of the connectors 3 and 5 respectively (the connectors 3 and 5 can be respectively detached from each other).

The second connector temporarily engaging parts 39 of the female connector 5 are formed with two protrusions 79 adjacent to each other in the direction of height of the female connector 5 (see FIG. 9(*b*)). The protrusions 79 protrude from bottom parts of elongated grooves 81. The grooves 81 are provided in side surfaces (side surfaces located in end parts in the longitudinal direction) of the second connector main body part 35 so as to be extended in the direction of height of the female connector 5. The height of the protrusions 79 is substantially equal to the depth of the grooves 81. The depth of the grooves 81 is substantially equal to the height of the protrusions 71 forming the first connector temporarily engaging parts 33. The width of the grooves 81 (a dimension in the direction orthogonal to a sheet surface of FIG. 9(*b*)) is substantially equal to the width of the protrusions 71 and 79.

Thus, when the female connector 5 is connected to the male connector 3, the protrusions 71 are engaged with the grooves 81 by forming sliding pairs, so that the female connector 5 is guide and moved to the male connector 3 in the attaching and detaching direction (the direction of height) in place of or in addition to the engagement of the above-described ribs 49 and the grooves 51.

Further, when the female connector 5 is temporarily connected to the male connector 3, as shown in FIG. 9(*b*), the protrusions 71 forming the first connector temporarily engaging parts 33 enter between the two protrusions 79 adjacent to each other so that the temporarily connected state of the female connector 5 and the male connector 3 may be maintained.

In the female connector 5 and the male connector 3, the grooves 81 may be provide not only in the second connector main body part 35, but also in the tubular part 29 of the male connector 3. In one pairs of connector temporarily engaging parts 33 and 39 respectively, the number of protrusions 71 may be set to two and the number of protrusions 79 may be set to one, and under the temporarily connected state, the protrusions 79 may be inserted between the two protrusions 71.

The second protrusion 47 of the female connector 5 includes a standing part 83 and a pair of protruding parts 85 formed integrally with the second connector main body part 35. The standing part 83 is formed in the figure of a pole such as a square pole and forms the second abutted part 19. The push-in part 17 of the jig 9 for the connector abuts on an upper surface of the standing part 83. Further, the standing part 83 protrudes from the upper surface of the second connector main body part 35 in the central part of the second connector main body part 35.

The protruding parts 85 are formed in the figures of poles such as cylindrical forms to form the second engaged parts 27. Further, the protruding parts 85 are provided in the standing part 83 in such a way that a direction of height thereof (an extending direction of an axis) corresponds to the transverse direction of the second connector main body part 35. Thus, the second protrusion 47 is formed in the figure of a "cross". When the male connector 3 and the female connector 5 which are temporarily connected together do not need to be detached from each other, the protruding parts 85 may be deleted.

Now, the jig 9 for the connector will be described below.

The jig 9 for the connector includes, as shown, for instance, in FIG. 2, urging members (for instance, compression coil springs) 87 which urge the engaging members 53 to rotate in prescribed directions (directions shown by arrow marks A1 and A2 on axes C1 and C2 as centers as well as the above-described jig main body part 59, the bolt 55, the one pair of engaging members 53, the push-in member 57 and the pull-out member 61.

Figure 4:
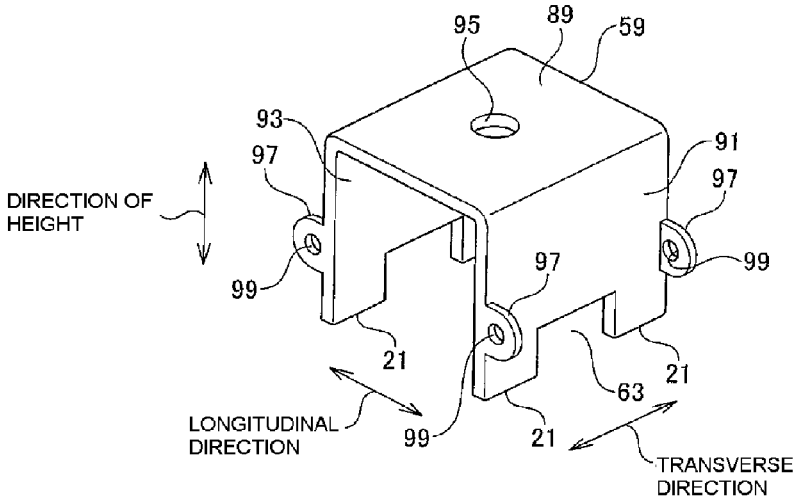
FIG. 4 is a perspective view showing a schematic structure of a jig main body part of a jig for a connector.

The jig main body part 59 includes, as shown in FIG. 4(*a* perspective view showing a schematic structure of the jig main body part 59), a rectangular flat plate shaped base part 89, a first rectangular flat plate shaped side part 91 and a second side part 93 formed in the same figure as that of the first side part 91, and is formed with, for instance, metal. When the jig main body part 59 formed in such a way is viewed from the direction of height, the jig main body part 59 has a rectangular form which is the form of the base part 89. Further, when the jig main body part 59 is viewed from the longitudinal direction, the jig main body part 59 has a figure of "U". Further, elongated, rectangular and planar end surfaces (surfaces opposite to the base part 89) of the side parts 91 and 93 of the jig main body part 59 respectively form the abutting parts 21 abutting on the first abutted parts 23 of the male connector 3.

In a central part of the base part 89, is provided a moving member engaging part 95 (e.g., an internal thread) with which the moving member 55 (e.g., a bolt) is engaged. The moving member engaging part 95 is formed by an internal thread passing through in the direction of height of the base part 89 (the direction of height of the jig main body part 59). A screw part (an engaging part to the jig main body part) of the bolt 55 is screwed to the internal thread 95. In the bolt 55 screwed to the internal thread 95, as shown in FIG. 2, a head part of the bolt 55 is located in an opposite side to the side parts 91 and 93 respectively in the direction of height of the jig main body part 59 (the jig 9 for the connector). An end part side of an external thread of the bolt 55 is located near the side parts 91 and 93 respectively. The end part side of the external thread of the bolt 55 is located between the side parts 91 and 93 in the transverse direction. Further, the bolt 55 obtains a thrust by rotating the bolt 55 to move relative to the jig main body part 59 in the direction of height of the jig main body part 59.

Further, in the first side part 91 of the jig main body part 59, the cut-out part 63 and a pair of first engaging member support parts 97 are provided. The cut-out part 63 is formed in a rectangular shape and provided in an end part (a lower part) of the first side part 91 in the direction of height of the jig main body part 59 and in an intermediate part of the first side part 91 in the longitudinal direction of the jig main body part 59.

One engaging member support part 97 of the one pair of engaging member support parts 97 is formed in the figure of a small plate having a circular through hole 99 in a central part and is provided integrally with the first side part 91 so that the direction of thickness of the plate and a passing direction of the through hole 99 correspond to the longitudinal direction of the jig main body part 59.

Further, the one engaging member support part 97 of the one pair of engaging member support parts 97 protrudes outside (toward a side separating from the second side part 93) from the first side part 91 in the transverse direction of the jig main body part 59, is located in an intermediate part of the first side part 91 in the direction of height of the jig main body part 59 and located in one side of the first side part 91 in the longitudinal direction of the jig main body part 59.

The other engaging member support part 97 of the one pair of engaging member support parts 97 is provided symmetrically with the one engaging member support part 97 relative to a plane passing the center of the first side part 91 (a plane passing the center of the first side part 91 and orthogonal to the longitudinal direction of the jig main body part 59).

The second side part 93 of the jig main body part 59 and the cut-out part 63 and a pair of engaging member support parts 97 provided in the second side part 93 are provided symmetrically with the first side part 91, the cut-out part 63 or the engaging member support parts 97 relative to a plane passing the center of the jig main body part 59 (a plane passing the center of the jig main body part 59 and orthogonal to the transverse direction of the jig main body part 59).

In the end part of the bolt 55 (a part opposite to the hexagonal pole shaped head part), for instance, a ring shaped groove (a constriction) 101 is provided as shown in FIG. 2. The part where the constriction 101 is provided forms a second engaging member support part 103 which is engaged with the push-in member 57 or the pull-out member 61 and supports them.

The one pair of engaging members 53 (53A, 53B) are formed with, for instance, metal and provided symmetrically relative to a plane passing the center of the jig 9 for the connector and orthogonal to the transverse direction as in the case of the side parts 91 and 93 respectively. Since the engaging members 53A and 53B are respectively formed in the same figures, here, the form of the one engaging member 53A will be described.

Figure 6:
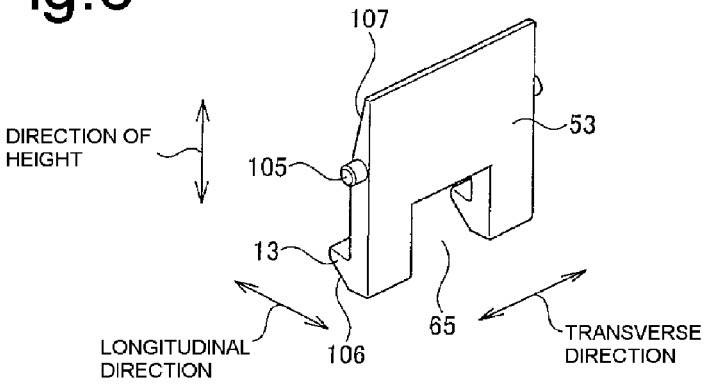
FIG. 6 is a perspective view showing a schematic structure of a hook member of the jig for the connector.

As shown in FIG. 6, the engaging member 53A is formed in the shape of a substantially rectangular plate having a prescribed thickness. Further, in the engaging member 53A, the cut-out part 65, the engaging parts 13 engaged with the first protrusions 43 of the male connector 3 and a pair of supported parts 105 engaged with the engaging member support parts 97 of the jig main body part 59.

The cut-out part 65 is formed in a rectangular shape and is provided in an end part (a lower part) of the engaging member 53A in the direction of height of the engaging member 53A and in an intermediate part of the engaging member 53A in the longitudinal direction of the engaging member 53A.

The engaging parts 13 are formed with protrusions having inclined surfaces 106. The protrusions are provided in the end part (the lower part) of the engaging member 53A in the direction of height of the engaging member 53A and over an entire length excluding a part in which the cut-out part 65 is provided in the longitudinal direction of the engaging member 53A and protrude from one end surface (a surface near the first side part 91 when the engaging member 53A is installed in the jig main body part 59) in the transverse direction (the direction of thickness) of the engaging ember 53A.

One supported part 105 of the one pair of supported parts 105 is formed in a cylindrical shape having an outside diameter substantially equal to an inside diameter of the through hole 99 provided in the engaging member support part 97 of the jig main body part 59. Then, the one supported part 105 is provided in an intermediate part of the engaging member 53A in the direction of height and the transverse direction (the direction of thickness) of the engaging member 53A and protrudes from one end surface in the longitudinal direction of the engaging member 53A. The other supported part 105 of the one pair of supported parts 105 is provided symmetrically with the one supported part 105 relative to a central surface of the engaging member 53A (a plane passing the center of the engaging member 53A and orthogonal to the longitudinal direction of the engaging member 53A.

A longitudinal dimension of the rectangular jig main body part 59 is substantially equal to a dimension between the engaging member support parts 97 provided in the first side part 91 (the second side part 93) of the jig main body part 59. Further, in the engaging member 53A, an inclined surface part 107 is provided. The inclined surface part 107 is provided in an upper end side of the engaging member 53A and in a side where the engaging parts 13 are provided. In a part where the inclined surface 107 is provided, as the thickness of the engaging member 53A goes toward an upper end part thereof, the thickness of the engaging member 53A is smaller.

Then, when the supported parts 105 of the engaging members 53 are allowed to be fitted to the engaging member support parts 97 of the jig main body part 59 to arrange the one engaging member 53A in the first side part 91 and the other engaging member 53B in the second side part 93, the one pair of engaging members 53 are located outside the jig main body part 59 in the transverse direction of the jig main body part 59, as shown in, for instance, FIG. 2. At this time, the one pair of engaging parts 13 are located under the jig main body part 59 and protrude inside the jig main body part 59.

Further, since the engaging members 53 are urged by the compression coil springs 87, under an ordinary state (a state shown in FIG. 2; a state in which any external force is not applied to the jig 9 for the connector), the directions of thickness of the engaging members 53 correspond to the directions of thickness of the side parts 91 and 93.

Further, in the ordinary state, a distance L1 between end parts of the one pair of engaging parts 13 is substantially equal to a dimension L2 of an external form of the tubular part 29 of the male connector 3 in the transverse direction. On the other hand, a distance L3 between base end parts of the one pair of engaging parts 13 is substantially equal to a distance L4 between the first protrusion 43A and the first protrusion 43B (43C) of the male connector 3 (see FIG. 3 together with FIG. 2).

Figure 13:
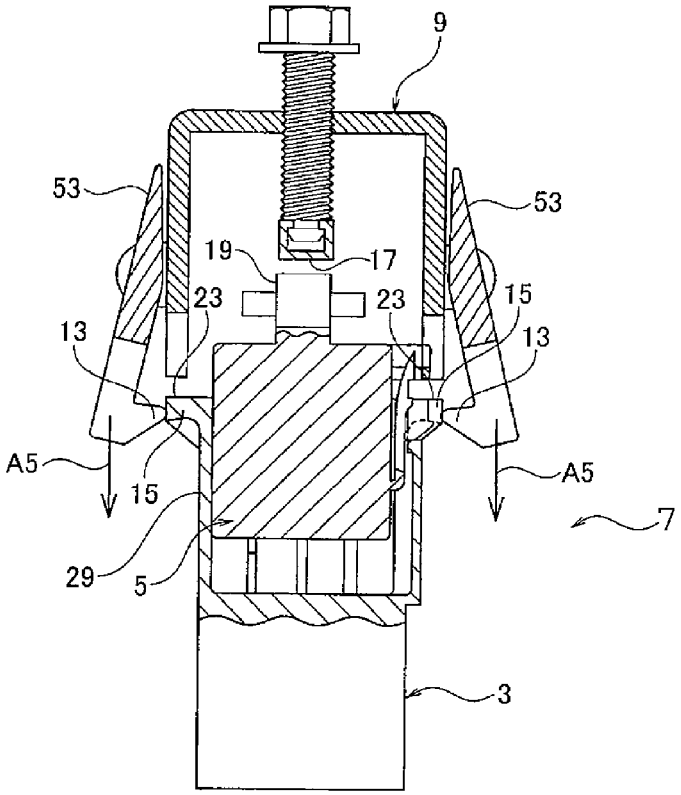
FIG. 13 is a view showing a state that the jig for the connector is halfway arranged on the male connector and the female connector which are temporarily connected.

When the jig 9 for the connector is installed on the connectors 3 and 5 which are respectively temporarily arranged, the one pair of engaging members 53 are rotated in the directions shown by the arrow marks A1 and A2 in FIG. 2 (see FIG. 13) so that the jig 9 for the connector may be easily installed. Namely, as shown in FIG. 13, the inclined surfaces 106 of the engaging members 53 abut on the first protrusions 43 of the male connector 3 so that the engaging members 53A and 53B respectively have a shape of "∧" to increase a distance between the engaging parts 13. Thus, the jig 9 for the connector is easily installed on the connectors 3 and 5 respectively temporarily arranged. Further, the inclined surface parts 107 of the engaging members 53A and 53B are respectively provided to prevent the engaging members 53A and 53B from interfering with the jig main body part 59 when the engaging members 53A and 53B are respectively rotated as shown in FIG. 13.

Figure 5:
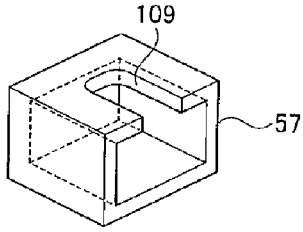
FIG. 5 is a perspective view showing a schematic structure of a push-in member of the jig for the connector.

The push-in member 57 is formed in the shape of a rectangular measure as shown in FIG. 5. In one side wall part adjacent to an opening part of the measure, a "U" shaped cut-out part 109 is formed. The part of the cut-out part 109 is engaged with the constriction 101 of the bolt 55 so that the push-in member 57 is detachably attached to the bolt 55 as shown in FIG. 2. The other side wall part (a side wall part opposed to the side wall part having the "U" shaped cut-out part 109 formed) of the measure shaped push-in member 57 forms the push-in part 17 abutting on the second abutted part 19 of the female connector 5.

Now, the pull-out member 61 will be described below in detail.

Figure 19:
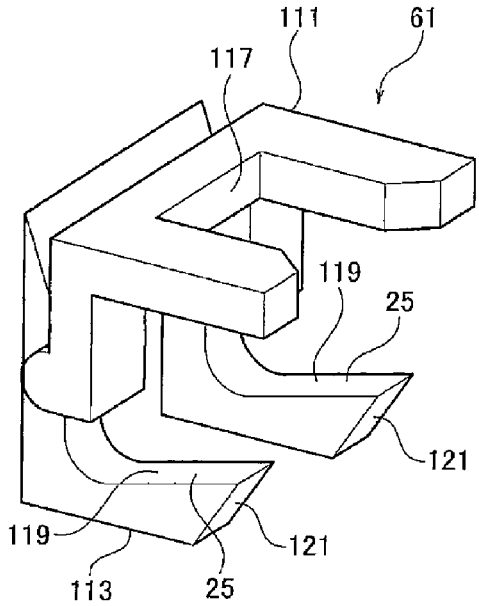
FIG. 19 is a perspective view showing a schematic structure of a pull-out member of the jig for the connector.
Figure 20:
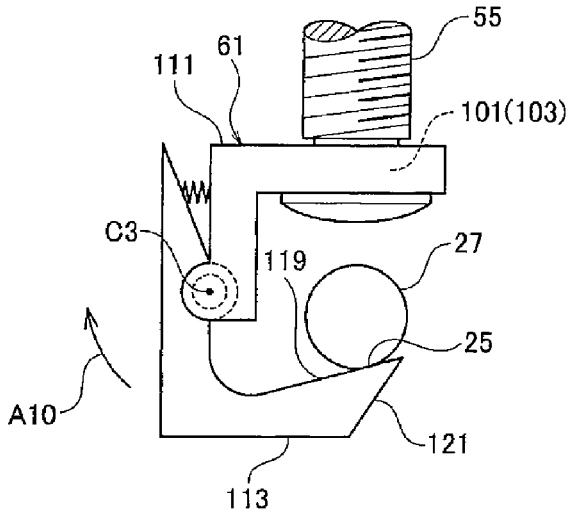
FIG. 20 is a front view of the pull-out member of the jig for the connector.
Figure 21A:
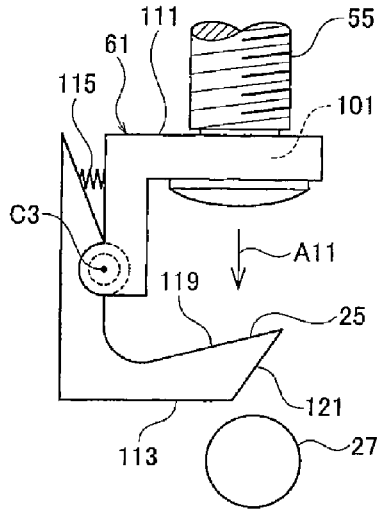
FIG. 21(*a*) is a front view before an engaging operation of the pull-out member of the jig for the connector.
Figure 21B:
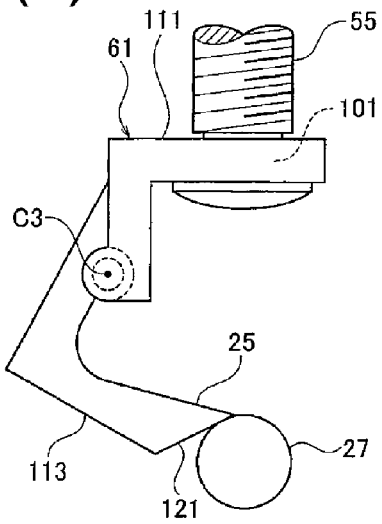

FIG. 19 is a perspective view showing a schematic structure of the pull-out member 61. FIG. 20 and FIG. 21 are front views of the pull-out member 61. FIG. 20 shows a state that the pull-out member 61 is attached to the bolt 55 and the pull-out parts 25 of the pull-out member 61 are engaged with the engaged parts 27 of the second connector 5 so that second connector 5 may be pulled out. FIG. 21(*a*) shows a state that the pull-out member 61 is arranged in the bolt 55 before the pull-out parts 25 are engaged with the engaged parts 27 of the second connector 5. FIG. 21(*b*) shows a state that the pull-out member 61 is arranged in the bolt 55 in the course of an engagement of the pull-out parts 25 of the pull-out member 61 with the engaged parts 27 of the second connector 5.

The pull-out member 61 includes a base member 111, a pawl member 113 and an urging member (for instance, a compression coil spring) 115. In the base member 111, a cut-out part 117 is provided. The part of the cut-out part 117 is engaged with the constriction 101 of the bolt 55 so that the pull-out member 61 is detachably attached to the bolt 55.

The pawl member 113 is provided in the base member 111 so as to rotate in a direction shown by an arrow mark A10 on an axis C3 as a center of rotation shown in FIG. 20 from a state (an ordinary state) shown in FIG. 20. Further, inclined surfaces 119 and 121 are provided on the pawl member 113. The inclined surface 119 is an inclined surface forming the pull-out part 25. The inclined surface 121 is an inclined surface for rotating the pawl member 113 (the pull-out part 25) against an urging force of the compression coil spring 115 when the pawl member 113 is engaged with the engaged part 27 (the protruding part 85) of the second connector 5 (see FIG. 21(*b*)).

Figure 22:
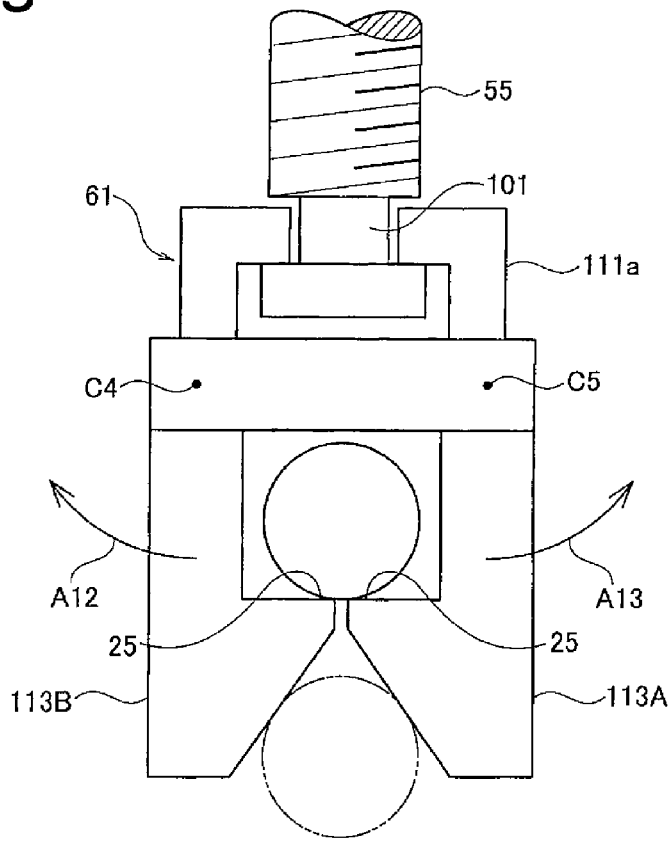
FIG. 22 is a view showing a modified example of the pull-out member of the jig for the connector.
Figure 23:
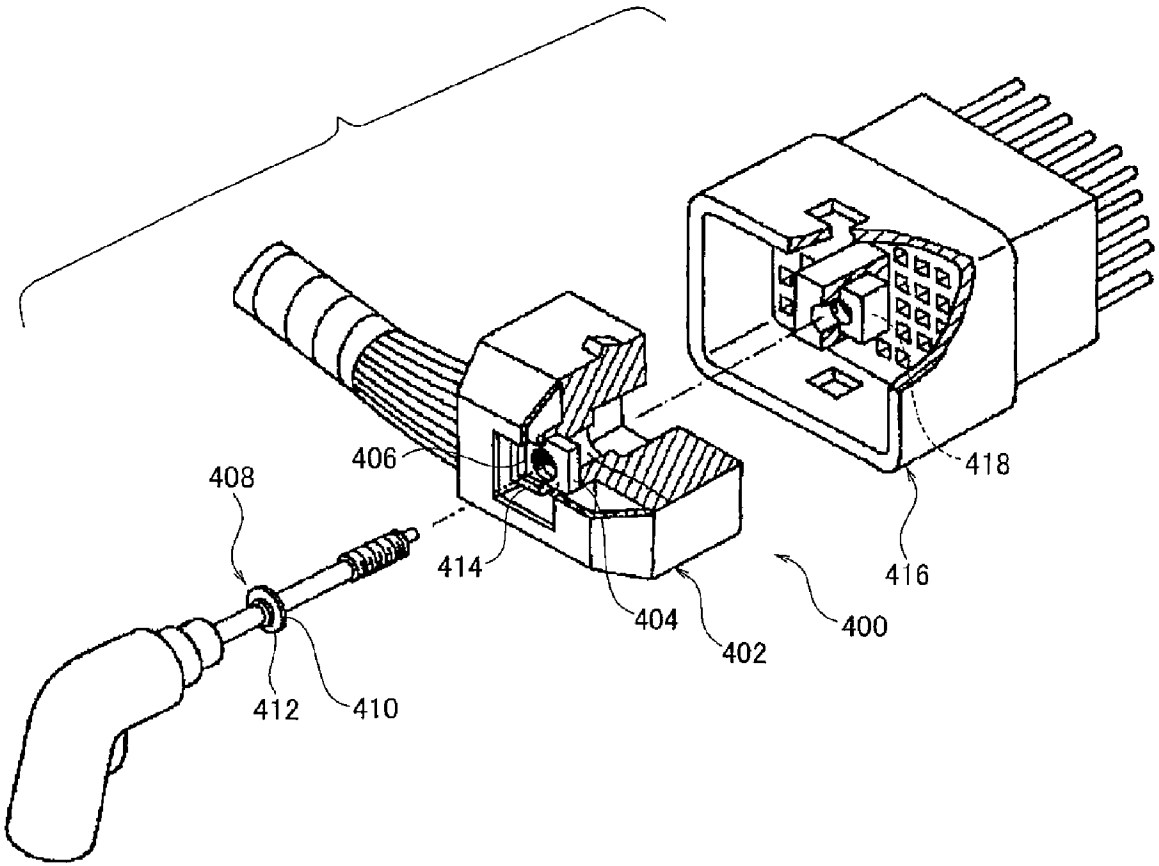
RELATED ART Fig.23
FIG. 23 is a perspective view showing a schematic structure of a usual connector.

In FIG. 20 or FIGS. 21(*a*) and 21(*b*), only one pawl member 113 is provided, however, as shown in FIG. 22 (a diagram showing a modified example of the pull-out member), one pair of pawl members 113A and 113B may be provided in a base member 111a, and the pair of pawl members 113A and 113B may be engaged with the second engaged parts 27 (the protruding parts 85) of the female connector 5. In this case, one pawl member 113A rotates on an axis C5 as a center of rotation in a direction shown by an arrow mark A13 from an ordinary state. The other pawl member 113B rotates on an axis C4 as a center of rotation in a direction shown by an arrow mark A12 from an ordinary state.

In the jig 9 for the connector, the push-in member 57 or the pull-out member 61 is detachably attached to the bolt 55 and either the push-in member 57 or the pull-out member 61 is attached to the bolt 55. However, the bolt 55 may be formed integrally with the push-in member 57, or the bolt 55 may be formed integrally with the pull-out member 61. Further, when the female connector 5 is pushed in to the male connector 3, the push-in member 57 shown in FIG. 5 is not used and the bolt 55 may be allowed to directly abut on the second abutted part 19 of the female connector 5.

Now, an operation when the male connector 3 and the female connector 5 which are separated from each other are connected to each other will be described by referring to FIG. 7 to FIG. 18.

Figure 8:
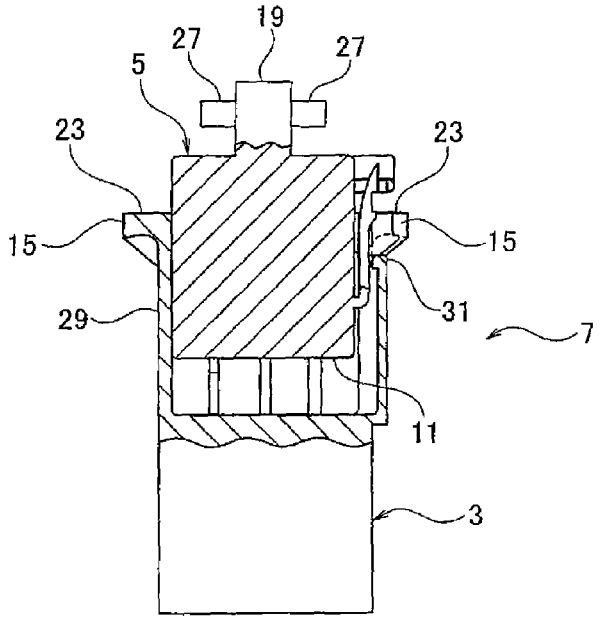
FIG. 8 is a view showing a section taken along a line VIII-VIII in FIG. 7.

FIG. 7 is a perspective view showing the male connector 3 and the female connector 5 in a temporarily connected state. FIG. 8 is a view showing a section taken along a line VIII-VIII in FIG. 7. FIG. 9(*a*) is a view showing a section taken along a line IX-IX in FIG. 7. FIG. 9(*b*) is an enlarged view of a part IX in FIG. 9(*a*).

Figure 10:
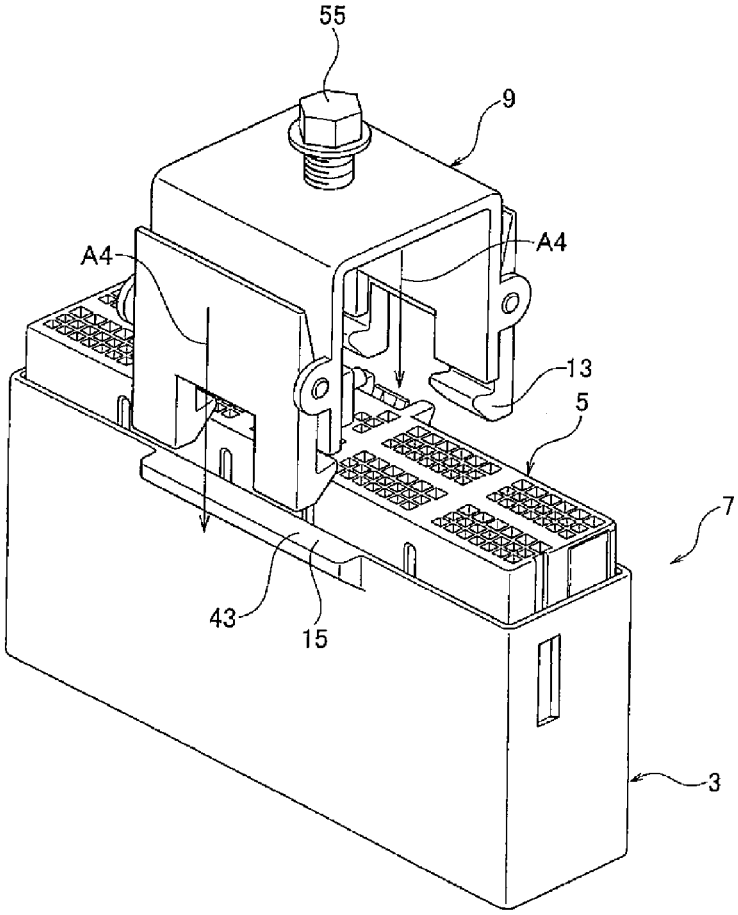
FIG. 10 is view showing a state before the jig for the connector is arranged on the male connector and the female connector which are temporarily connected.
Figure 11:
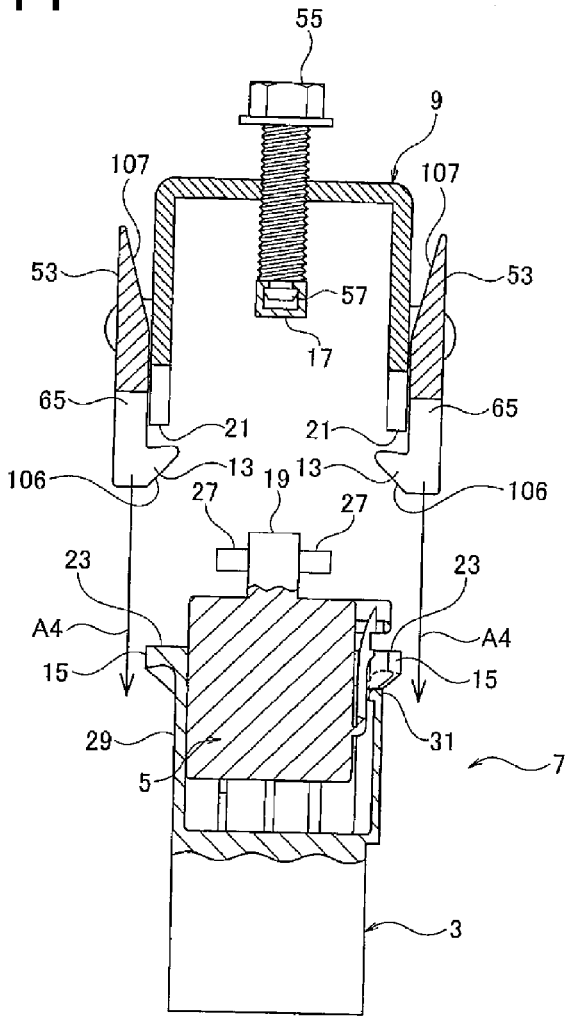
FIG. 11 is view showing a state before the jig for the connector is arranged on the male connector and the female connector which are temporarily connected.
Figure 12:
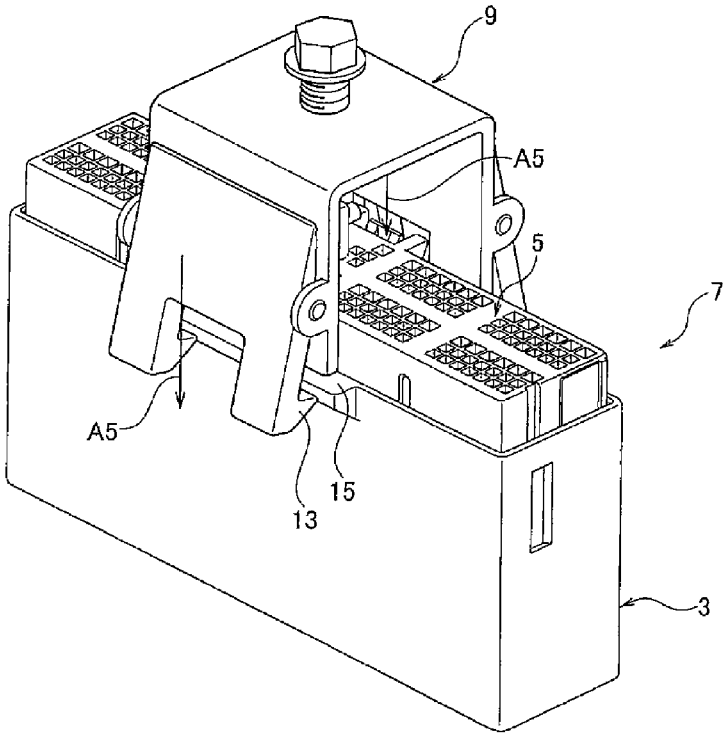
FIG. 12 is a view showing a state that the jig for the connector is halfway arranged on the male connector and the female connector which are temporarily connected.
Figure 14:
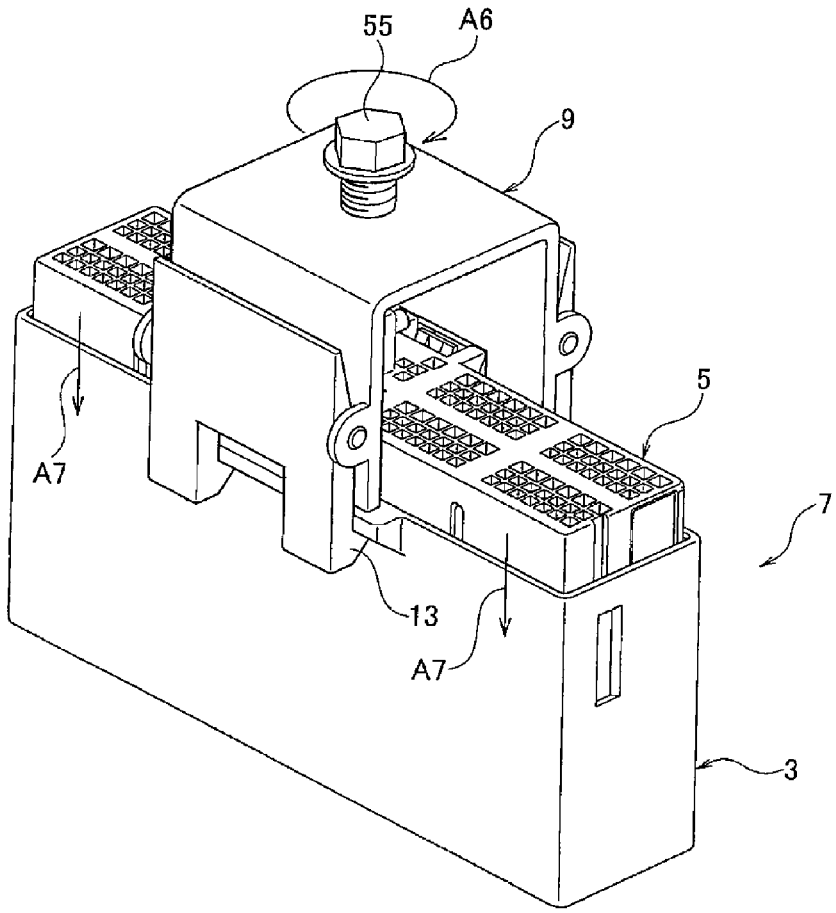
FIG. 14 is a view showing a state that the jig for the connector is completely arranged on the male connector and the female connector which are temporarily connected.
Figure 15:
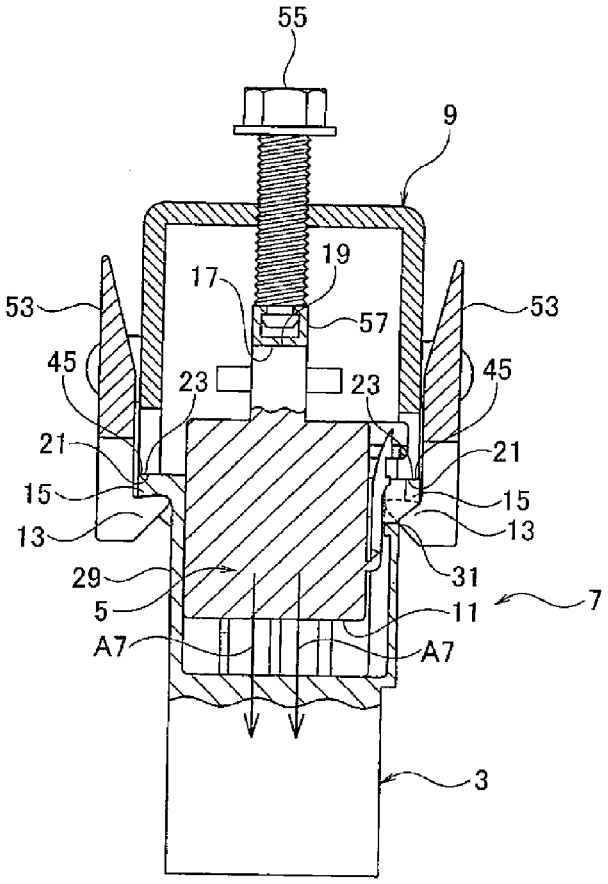
FIG. 15 is a view showing a state that the jig for the connector is completely arranged on the male connector and the female connector which are temporarily connected.
Figure 16:
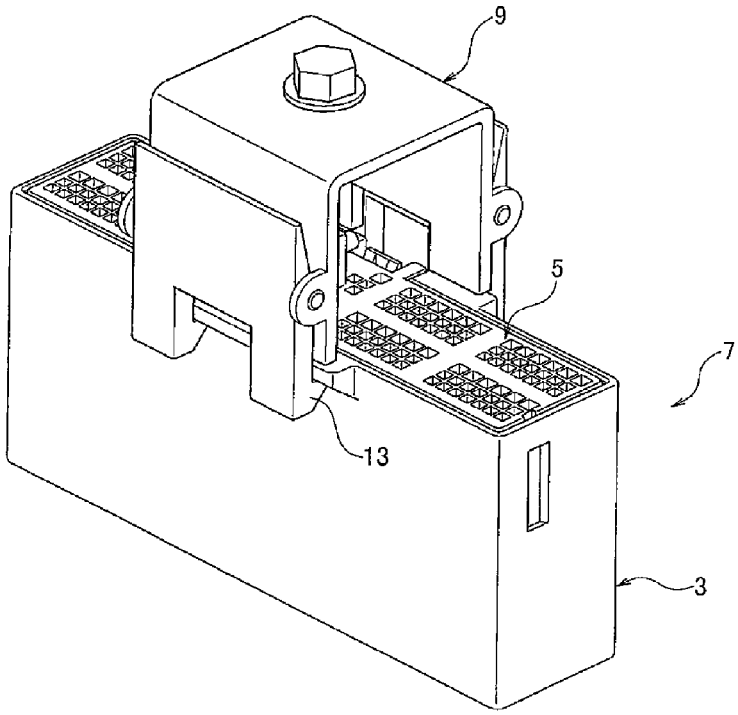
FIG. 16 is a view showing a state that the male connector is actually connected to the female connector by the jig for the connector.

FIG. 10 and FIG. 11 are views showing a state before the jig 9 for the connector is arranged on the male connector 3 and the female connector 5 which are temporarily connected. FIG. 12 and FIG. 13 are views showing a state that the jig 9 for the connector is halfway arranged on the male connector 3 and the female connector 5 which are temporarily connected. FIG. 14 and FIG. 15 are views showing a state that the jig 9 for the connector is completely arranged on the male connector 3 and the female connector 5 which are temporarily connected. FIG. 16 and FIG. 17 are views showing a state that the male connector 3 is fully connected to the female connector 5 by the jig 9 for the connector. FIG. 18 is an enlarged view of a part XVIII in FIG. 17.

Initially, an operator who carries out a connecting operation moves the female connector 5 by, for instance, empty hands, in a direction shown by an arrow mark A3 in FIG. 3 to temporarily connect the male connector 3 to the female connector 5 (see FIG. 7 to FIG. 9).

Subsequently, as shown in FIG. 10 to FIG. 15, the jig 9 for the connector to which the push-in member 57 is attached is arranged on the male connector 3 and the female connector 5 which are temporarily connected to each other. Namely, as shown in FIG. 10, the jig 9 for the connector is located in a position above the male connector 3 and the female connector 5 and the jig 9 for the connector is moved in a direction (downward) shown by an arrow mark A4 in FIG. 10 and FIG. 11. In accordance with this movement, the inclined surfaces 106 of the engaging members 53 abut on the first protrusions 43 of the male connector 3 so that the engaging embers 53 are rotated to widen a space between the one pair of engaging parts 13 (see FIG. 12, FIG. 13). The jig 9 for the connector is more moved in a direction (downward) shown by an arrow mark A5 from the state shown in FIG. 12 or FIG. 13.

In accordance with this movement, the inclined surfaces 106 of the engaging members 53 are disengaged from the first protrusions 43 of the male connector 3 and the engaging members 53 are returned to original rotating angles (positions shown in FIG. 10 and FIG. 11) by urging forces of the compression coil springs 87. Thus, the jig 9 for the connector is completely arranged on the male connector 3 and the female connector 5 (see FIG. 14 and FIG. 15). In the state shown in FIG. 14 and FIG. 15, the abutting parts 21 of the jig main body part 59 abut on the upper surfaces of the first protrusions 43 of the male connector 3. Further, small gaps are formed between the engaging parts 13 of the engaging members 53 of the jig 9 for the connector and the first protrusions 43 of the male connector 3.

Subsequently, under the state shown in FIG. 14 or FIG. 15, when the bolt 55 is rotated as shown by an arrow mark A6, the bolt 55 is lowered so that the push-in member 57 pushes-in the female connector 5 (the second abutted part 19). The jig 9 for the connector is entirely slightly lifted by a reaction force (an upward force) due to the push-in operation. Thus, small gaps are formed between the abutting parts 21 of the jig main body part 59 and the upper surfaces of the first protrusions 43 of the male connector 3. The engaging parts 13 of the engaging members 53 of the jig 9 for the connector come into contact with the first protrusions 43 of the male connector 3 and the engaging parts 13 receive a pressing force (a downward force) from the first protrusions 43.

When the bolt 55 is further rotated as shown by the arrow mark A6, the bolt 55 is further lowered, the female connector 5 is moved downward (a direction shown by an arrow mark A7 in FIG. 14 or FIG. 15) and the female connector 5 is pushed-in to the male connector 3 to fully connect the female connector 5 to the male connector 3 (see FIG. 16, FIG. 17).

When the female connector is fully connected to the male connector, as shown in FIG. 18, the protruding part 77 forming the second connector lock part 37 abuts on the protrusion 67 forming the first connector lock part 31 to prevent the detachment of the female connector 5 (the second terminals 11) from the male connector 3 (the first terminals). Namely, under the state shown in FIG. 18, since the protruding part 77 abuts on the protrusion 67 under the protrusion 67, even when the female connector 5 tries to move upward relative to the male connector 3, the protruding part 77 is engaged with the protrusion 67, so that female connector cannot be moved upward.

In a halfway state that the temporarily connected state shifts to the fully connected state, the female connector 5 is initially located above the male connector 3 and the protruding part 77 is separated from the protrusion 67 in the upper part of the protrusion 67, which is different from the state shown in FIG. 18. When the female connector 5 is moved downward relative to the male connector 3 from this state, the protruding part 77 abuts on the protrusion 67 and the rod shaped part 75 is elastically deformed and bent in the direction shown by the arrow mark A8 in FIG. 18. In accordance with this bending movement, the female connector 5 can be further moved downward relative to the male connector 3 and the protruding part 77 gets over the protrusion 67. When the protruding part 77 completely gets over the protrusion 67, the male connector 3 and the female connector 5 are completely fully connected to each other, the rod shaped part 75 is restored in the direction shown by an arrow mark A8 to obtain the state shown in FIG. 18.

Now, an operation will be described below for detaching the female connector 5 from the male connector 3 under the state that the male connector and the female connector are fully connected to each other.

Initially, as shown in FIG. 16 or FIG. 17, the jig 9 for the connector is arranged on the male connector 3 and the female connector 5 which are fully connected to each other. In FIG. 16 or FIG. 17, the push-in member 57 is attached to the bolt 55 of the jig 9 for the connector, however, when the female connector 5 is detached from the male connector 3, the pull-out member 61 shown in FIG. 19 is attached in plate of push-in member 57. Further, when the jig 9 for the connector is arranged, as shown in FIG. 21(*a*), FIG. 21(*b*) and FIG. 20 in order, the pull-out member 61 is engaged with the second engaged part 27 of the female connector 5.

Subsequently, under the state shown in FIG. 18, when the force shown by the arrow mark AR in FIG. 18 is applied to the second connector lock part 37 (the rod shaped part 75) through the cut-out part 63 of the jig main body part 59 and the cut-out part 65 of the engaging member 53 to elastically deform and bend the rod shaped part 75 in the direction shown by the arrow mark A8 to disengage (release the abutment of) the protruding part 77 from protrusion 67.

When the protruding part 77 is not allowed to abut on the protrusion 67 in such a way and the bolt 55 is rotated counterclockwise (in an opposite direction to the direction shown by the arrow mark A6 in FIG. 14), the bolt 55 is lifted. In accordance with the lifting operation of the bolt 55, the female connector 5 is pulled out upward relative to the male connector 3 so that the male connector 3 is temporarily connected to the female connector 5. When the male connector and the female connector are temporarily connected to each other, the protruding part 77 is separated from the protrusion 67 and located above the protrusion 67 differently form the state shown in FIG. 18 and the second connector lock part 37 (the rod shaped part 75) is restored. Further, when the female connector 5 is pulled out before the female connector is temporarily connected to the male connector, the bolt 55 receives a downward force and the abutting parts 21 of the jig main body part 59 abutting on the first protrusions 43 of the male connector 3 receive an upward force.

In the connector 7, since a bolt or a nut is not provided for each of the connectors 3 and 5 like the usual connector 400, the connector 7 is lightened, the structure of the connector 7 is simplified, the production process of the connector 7 is simplified and the production cost of the connector 7 can be reduced.

As already understood, since the bolt or the nut is not provided as in the usual connector 400, the connectors 3 and 5 are connected to each other in such a way that the engaging parts 13 of the jig 9 for the connector are engaged with the first engaged parts 15 of the male connector 3 and the push-in part 17 of the jig 9 for the connector is allowed to abut on the second abutted part 19 of the female connector 5 to push the female connector 5 by the push-in part 17 of the jig 9 for the connector.

Further, as already understood, since the bolt or the nut is not provided as in the usual connector 400, the connectors 3 and 5 are detached from each other in such a way that the abutting parts 21 of the jig 9 for the connector are engaged with the first abutted parts 23 of the male connector 3 and the pull-out parts 25 of the jig 9 for the connector are engaged with the second engaged parts 27 of the female connector 5 to pull out the female connector 5 by the engaging parts 27 of the jig 9 for the connector.

Further, in the connector 7, since the connector lock parts 31 and 37 are respectively provided, the detachment of the connectors 3 and 5 which are respectively connected (fully connected) to each other is prevented. When the connectors 3 and 5 which are connected to each other are detached from each other, the external force needs to be especially applied to the second connector lock part 37. Thus, under a state that the male connector 3 and the female connector 5 which are connected to each other are used, the male connector and the female connector are prevented from being detached from each other. On the other hand, when the male connector 3 and the female connector 5 which are connected to each other are detached from each other, the external force may be especially applied to the second connector lock part 37, in the case of a repair, the connectors 3 and 5 which are connected to each other can be easily detached from each other in accordance with an intention of the operator.

Further, in the connector 7, the jig 9 for the connector is used so that the multi-polar connectors may be easily connected to or separated from each other.

The present invention is not limited to the above-described exemplary embodiment and can be suitably modified and improved. In addition, materials, forms, dimensions, numeric values, modes, numbers, arranged positions, etc. of component elements in the above-described embodiment which can achieve the present invention are arbitrary and are not limited.

The present invention is described in detail by referring to the specific exemplary embodiment, however, it is to be understood to a person with ordinary skill in the art that various changes or modifications may be made without departing from the spirit and scope of the present invention.

According to the present invention, the connector which is light and has a simplified structure and the jig for the connector used for attaching and detaching the connector can be effectively obtained.

What is claimed is:

1. A connector comprising:

a first connector including:

a first connector main body part;

a plurality of first terminals protruding from an upper surface of the first connector main body part;

a tubular part protruding from the upper surface of the first connector main body part so as to surround the first terminals; and a first protrusion that protrudes outside the tubular part in a traverse direction and extends along the tubular part in a longitudinal direction that intersects the traverse direction; and a second connector including:

a second connector main body part;

a plurality of second terminals which are provided on a bottom surface of the second connector main body part and into which the plurality of first terminals are respectively inserted in an attachment direction that intersects the traverse direction and the longitudinal direction; and a second protrusion that protrudes from an upper surface of the second connector main body part and extends in the attachment direction.

2. The connector according to claim 1, wherein the first connector further includes a first connector lock part on an inside surface of the tubular part facing the first terminals, the second connector main body part has an outside surface that includes a second connector lock part, the second connector lock part is configured to be engaged with the first connector lock part and elastically deformed in the course of connecting the first terminals to the second terminals, and restored to be engaged with the first connector lock part when the first terminals are completely connected to the second terminals so that the second terminals are prevented from being detached from the first terminals, and the second connector lock part is configured to be elastically deformed by applying a prescribed external force thereto when the first terminals are connected to the second terminals so that the second connector lock part is disengaged from the first connector lock part, and the second connector lock part is separated from the first connector lock part and restored when the second terminals are completely detached from the first terminals.

3. A connector comprising:

a first connector including:

a plurality of first terminals that extend in an attachment direction;

first engaged parts;

first abutted parts; and a second connector having a top surface that is in a plane that intersects with the attachment direction, the second connector including:

a plurality of second terminals configured to be connected to the plurality of first terminals, respectively; and a standing part that is on the top surface of the second connector and extends in the attachment direction, the standing part including a second abutted part and second engaged parts, the second engaged parts extending from an outside surface of the standing part;

wherein the first and second connectors are connected to each other in such a way that engaging parts of jig for the connector are engaged with the first engaged parts of the first connector, and under a state that a push-in part of the jig for the connector is allowed to abut on the second abutted part of the standing part of the second connector, the second connector is pushed by the push-in part of the jig for the connector so as to allow the second connector to come close to the first connector, and the first and second connectors are detached from each other in such a way that abutting parts of the jig for the connector are allowed to abut on the first abutted parts of the first connector, and under a state that pull-out parts of the jig for the connector are engaged with the second engaged parts of the standing pert of the second connector, the second connector is pulled out by the pull-out parts of the jig for the connector so as to detach the second connector from the first connector.

4. The connector according to claim 3, wherein the first connector further includes a first connector lock part, the second connector further includes a second connector lock part the second connector lock part is configured to be engaged with the first connector lock part and elastically deformed in the course of connecting the first terminals to the second terminals, and restored to be engaged with the first connector lock part when the first terminals are completely connected to the second terminals so that the second terminals are prevented from being detached from the first terminals, and the second connector lock part is configured to be elastically deformed by applying a prescribed external force thereto when the first terminals are connected to the second terminals so that the second connector lock part is disengaged from the first connector lock part, and the second connector lock part is separated from the first connector lock part and restored when the second terminals are completely detached from the first terminals.

5. A jig for a connector used when a first connector is connected to a second connector and when the first connector and the second connector are detached from each other, the jig for the connector comprising:

a jig main body part including abutting parts configured to abut on first abutted parts of the first connector;

engaging members including engaging parts configured to be engaged with first engaged parts of the first connector, the engaging members being supported by the jig main body part; and a moving member that moves, in a first direction, through a hole that extends through the jig main body part and is configured to:

support a push-in member configured to abut on a second abutted part of a second protrusion that extends from the second connector in the first direction; and support a pull-out member configured to engage with second engaged parts of the second protrusion that extends from the second connector, the moving member being engaged with the jig main body part to move in the first direction.

6. The jig for a connector according to claim 5, wherein when the first connector is connected to the second connector, the push-in member is supported by the moving member, the engaging parts of the engaging members are engaged with the engaged parts of the first connector, and the moving member is moved so as to push the second connector to the first connector so that the push-in member is allowed to abut on the abutted part of the second connector and pushes the second connector to the first connector, and when the first connector and the second connector are detached from each other, the pull-out member is supported by the moving member, the abutting parts of the jig main body part are allowed to abut on the abutted parts of the first connector, the pull-out member is engaged with the second engaged parts of the second connector and the moving member is moved so as to detach the second connector from the first connector so that the second connector is separated from the first connector.

* * * * *